US007736113B2

(12) United States Patent
Yook et al.

(10) Patent No.: US 7,736,113 B2
(45) Date of Patent: Jun. 15, 2010

(54) APPARATUS FOR TRANSPORTING A MOTOR VEHICLE IN A PARKING SYSTEM

(75) Inventors: Kwang-hee Yook, Seoul (KR); Chang-guk Hwang, Incheon-si (KR); Wesley Kim, Seoul (KR)

(73) Assignee: MP System Co., Ltd. (KR)

( * ) Notice: Subject to any disclaimer, the term of this patent is extended or adjusted under 35 U.S.C. 154(b) by 0 days.

(21) Appl. No.: 11/842,744

(22) Filed: Aug. 21, 2007

(65) Prior Publication Data

US 2008/0031711 A1 Feb. 7, 2008

Related U.S. Application Data

(63) Continuation of application No. PCT/KR2005/002977, filed on Sep. 9, 2005.

(30) Foreign Application Priority Data

May 9, 2005 (KR) ..... 10-2005-0038352
Sep. 5, 2005 (KR) ..... 10-2005-0082187

(51) Int. Cl.
*E04H 6/12* (2006.01)

(52) U.S. Cl. ..... 414/256; 414/260

(58) Field of Classification Search ..... 414/253, 414/255, 256, 259, 260
See application file for complete search history.

(56) References Cited

U.S. PATENT DOCUMENTS 2,899,087 A * 8/1959 Jacobsen ..... 414/252
2,970,549 A * 2/1961 Volk et al. ..... 104/50
2,988,329 A * 6/1961 Sanders ..... 254/2 R
3,159,293 A * 12/1964 Bianca ..... 414/429
4,968,208 A * 11/1990 Friberg ..... 414/256
4,986,714 A * 1/1991 Fernstrom ..... 414/256
5,286,156 A 2/1994 Ikenouchi et al.
5,292,218 A * 3/1994 Ikenouchi et al. ..... 414/256
5,320,473 A * 6/1994 Arnold et al. ..... 414/253

(Continued)

FOREIGN PATENT DOCUMENTS

JP 2-186070 * 7/1990

(Continued)

OTHER PUBLICATIONS

International Search Report, Feb. 28, 2006, And Written Opinion of the International Searching Authority (6 pages).

*Primary Examiner*—James Keenan
(74) *Attorney, Agent, or Firm*—St. Onge Steward Johnston & Reens LLC

(57) ABSTRACT

Disclosed herein is a vehicle transport apparatus for parking systems. The vehicle transport apparatus of the present invention includes a first platform, onto which a vehicle is placed, a second platform, which is provided in a parking space, and a pair of carriers and which move between the first platform and the second platform. Each carrier includes a main frame, a drive wheel which is provided in the main frame, a drive motor which rotates the drive wheel; a pair of arms which are rotatably mounted to each of opposite sides of the main frame, and a hydraulic device which rotates the arms. The arms lift the wheels when extracted from the main frame, and the carriers transports the vehicle lifted by the arms from one platform to another platform.

8 Claims, 20 Drawing Sheets

U.S. PATENT DOCUMENTS 5,851,098 A * 12/1998 Buckenauer et al. ..... 414/263
5,863,171 A * 1/1999 Engman ..... 414/256
7,648,320 B2 * 1/2010 Valli ..... 414/254

FOREIGN PATENT DOCUMENTS

JP 6000244 A 1/1999
KR 199629099 U 9/1996
KR 20000014645 A 3/2000
KR 100271109 B1 8/2000

* cited by examiner

APPARATUS FOR TRANSPORTING A MOTOR VEHICLE IN A PARKING SYSTEM

CROSS-REFERENCE TO RELATED APPLICATIONS

The present application is a continuation of pending International patent application PCT/KR2005/002977 filed Sep. 9, 2005 which designates the United States and claims priority from Korean patent applications No. 10 2005 0038352 filed May 9, 2005 and 10 2005 0082187 filed on Sep. 5, 2005. All prior applications are herein incorporated by reference in their entirety.

FIELD OF THE INVENTION

The present invention relates, in general, to parking systems and, more particularly, to a vehicle transport apparatus, which automatically transports and parks vehicles in parking spaces of a parking system, and a method for automatically transporting and parking vehicles using the same.

BACKGROUND OF THE INVENTION

Recently, automatic parking systems have been widely used for efficiently parking a large number of vehicles in limited spaces. Such a parking system includes a structure, such as a parking building or a parking tower, having therein a plurality of parking spaces, and a transport mechanism, which is provided in the structure and puts vehicles into or extracts them from the inner space of the structure.

Furthermore, in the parking system, a vehicle support plate which is called a pallet is used for parking vehicles. In detail, when a vehicle is placed at a predetermined position near an entrance of the structure for parking, the entrance opens. Thereafter, a driver parks the vehicle at a desired position on a pallet, which is provided at the bottom of the structure. Subsequently, the driver comes out through the entrance and operates a control panel, which is provided around the entrance, such that a parking process is conducted. Then, the transport mechanism, such as an elevator, carries the pallet, on which the vehicle is loaded. Subsequently, the transport mechanism places the vehicle along with the pallet into a vacant parking space, thus completing the parking process. Therefore, a pallet must be provided to every parking space in the structure. However, the conventional parking system using the pallet has the following disadvantages.

First, a lot of time is required to put a vehicle into or to extract it from the parking system. For example, when the vehicle is put into the parking system, the transport mechanism moves to a vacant parking space, takes a vacant pallet, and moves along with the vacant pallet to the entrance. Furthermore, when it is desired to consecutively park a plurality of vehicles into parking spaces of the parking system, because the above-mentioned parking processes are repeatedly conducted, time consumption increases. Moreover, when it is desired to extract the vehicles from the parking spaces of the parking system, the transport mechanism must put a vacant pallet for a first vehicle into a related parking space prior to extracting a subsequent vehicle after the first vehicle has been extracted. As such, because it is required to put the pallets into and to extract them from the parking spaces, the time required to put the vehicle into the parking system and extract it therefrom increases. Therefore, the waiting time at the entrance increases, so that the entrance of the parking system is congested, thus inconveniencing drivers.

Second, because a pallet must be provided in each parking space, and incidental equipment for the pallet is required, the parking system is very complex and has an increased volume. Accordingly, the incidence of malfunction is increased, and installation cost and maintenance cost are increased.

Third, every time the pallet is moved, noise and vibration occur. That is, typically, each pallet is larger than a vehicle so as to support the vehicle. As such, when a large pallet is put into or extracted from a parking space, vibration and noise occur. Disclosure of Invention Technical Problem Accordingly, the present invention has been made keeping in mind the above problems occurring in the prior art, and an object of the present invention is to provide a vehicle transport apparatus for a parking system which rapidly parks and extracts vehicles in and from the parking system, and a method for automatically transporting a vehicle using the same.

Another object of the present invention is to provide a vehicle transport apparatus for a parking system which has a simple structure.

A further object of the present invention is to provide a vehicle transport apparatus for a parking system which reduces vibration and noise.

SUMMARY OF THE INVENTION

In order to accomplish the above objects, in an aspect, the present invention provides a vehicle transport apparatus for parking systems, including: a pair of carriers that are independently movable between platforms, on which a vehicle to be parked is placed; supporters provided on each carrier, the supporters engaging with the wheels and pushing inwards, thus lifting the wheels of the vehicle, so that the carriers transport the vehicle, which is supported thereon, from one platform to another platform while the wheels of the vehicle are lifted by the supporters.

Preferably, one carrier carries the front wheels of the vehicle, and the other carrier carries the rear wheels of the vehicle.

Furthermore, preferably, after the supporters of one carrier engage with and lift some wheels of the vehicle, the other carrier moves to the remaining wheels of the vehicle and, thereafter, the supporters of the other carrier engage with and lift the remaining wheels.

Each platform may include a passage, which is formed in the bottom of the platform, so that the carriers are inserted and moved in the passage. Preferably, when two platforms are connected to each other, the passages of the platforms communicate with each other. The platform comprises a first platform provided in an entrance of the parking system, a second platform provided in each parking space, in which vehicles are parked, and a third platform movably provided between the first platform and the second platform and selectively connected to the first or second platform.

The third platform may move between the first platform and the second platform in a vertical, horizontal or oblique direction.

Each carrier may include: a main frame; and a drive wheel provided in the main frame and operated by a power unit, so that the main frame travels on the platforms. Each carrier may further include: a skid wheel provided in the main frame and contacting the bottoms of the platforms so that the skid wheel rotates when the main frame travels on the platforms. Each carrier may further include: guide rollers provided in sidewalls of the main frame and rotating while contacting the vertical sidewalls of the platforms, thus guiding linear movement of the main frame.

Each supporter may include arms which are extracted from the main frame by rotating in a horizontal direction with respect to the main frame, thus engaging with a wheel of the vehicle. The arms preferably support the front and rear portions of each wheel. The arms may be disposed parallel with each other when they support a wheel.

Each supporter may include: a rotating shaft coupled to the main frame, with a gear provided on a lower portion of the rotating shaft; the arms forcibly coupled to the rotating shaft by a key, so that the arms are extracted outwards from the main frame by rotating parallel with the main frame along with the rotating shaft, thus lifting the wheel of the vehicle; and an idle gear provided between the main frame and the arms and transmitting power to rotate the arms. The supporter may further include a roller provided on the upper surface of each arm so that the wheel may easily be placed onto the arms.

The roller may protrude from the upper surface of each arm, so that, when the arms rotate and are brought into contact with the circumferential outer surface of the wheel, the rollers are first bought into rolling contact with the wheel, thus reducing friction between the wheel and the arms, such that the wheel is easily placed onto the arms. The rollers may be provided in each arm of each supporter.

The supporters provided in each carrier may be operated by one hydraulic device.

The hydraulic device may include an oil tank provided in the carrier and storing hydraulic oil therein; a hydraulic pump coupled to the oil tank and generating hydraulic pressure; a plurality of hydraulic cylinders that reciprocate rack gears using the generated hydraulic pressure; the rack gears coupled to rods of the hydraulic cylinders and rotating the arms using pinion gears; and a hydraulic valve provided among the hydraulic pump and the hydraulic cylinders and adjusting a pressure and a direction of the hydraulic oil to be supplied to the hydraulic cylinders.

In another aspect, the present invention provides a method for automatically transporting a vehicle in a parking system, including the steps of: moving a vehicle transport apparatus having two carriers, which are independently movable, to a first platform, on which the vehicle is placed; lifting first wheels of the vehicle placed on the first platform using a first carrier; moving a second carrier to second wheels of the vehicle; lifting the second wheels of the vehicle using the second carrier; moving the vehicle transport apparatus to a second platform in a state in which the vehicle is lifted; and putting the vehicle down from the two carriers onto the second platform.

The step of lifting the first wheels of the vehicle may include the step of: pushing a rack gear using a hydraulic cylinder provided in the first carrier, so that an idle gear, which engages with the rack gear, is rotated, thus rotating a pinion gear rotating shaft coupled to the main frame, and rotating arms in a horizontal direction with respect to the main frame, thereby lifting the first wheels of the vehicle.

The step of moving the second carrier may include the steps of: advancing the second carrier towards the second wheels of the vehicle; detecting the position of the vehicle; and stopping the second carrier.

The step of detecting the position of the second wheels of the vehicle may include the steps of: moving the second carrier; advancing the second carrier towards the second wheels; detecting the position of the second wheels of the vehicle; and stopping the second carrier.

The step of lifting the second wheels of the vehicle may include the step of: pushing a rack gear using a hydraulic cylinder provided in the second carrier, so that an idle gear, which engages with the rack gear, is rotated, thus rotating a pinion gear rotating shaft coupled to the main frame, and rotating arms in a horizontal direction with respect to the main frame, thereby lifting the second wheels of the vehicle.

In the vehicle transport method according to the present invention, preferably, the carriers rotate the arms using hydraulic pressure such that the arms are brought into close contact with the circumferential outer surfaces of the wheels of the vehicle, thus lifting the wheels.

The step of moving the carriers to the second platform may include the steps of: connecting a third platform, provided in a carrying device, to the first platform; moving the vehicle transport apparatus from the first platform to the third platform; moving the third platform using the carrying device and connecting the third platform to the second platform; and moving the vehicle transport apparatus from the third platform to the second platform.

In the conventional parking system, the pallets cannot be automatically moved, so the pallets must be manually put into or extracted from parking spaces by separate apparatuses. Moreover, the pallet is very heavy and has a large volume. Therefore, the transport speed of the pallet is relatively slow. In contrast, in the present invention, the small vehicle transport apparatus automatically moves according to an optimized vehicle transport method while loading a vehicle thereon, thus efficiently parking the vehicle in a desired parking space of the parking system or extracting the vehicle from the parking system. Therefore, the present invention reduces the time required to put or extract the vehicle into or from the parking system. Furthermore, because the vehicle transport apparatus is automatically operated, the vehicle transport apparatus can move to a standby position, that is, to the carrying device to prepare for subsequent operation immediately after conducting a requested operation (for example, a parking operation). As well, the present invention does not require the extraction of a vacant pallet from a parking space or the return of a vacant pallet into a parking space, unlike the conventional parking system. These characteristics of the present invention make it possible for the present invention to consecutively put vehicles into the parking system or extract them from the parking system, thus reducing the time required to put or extract the vehicles into or from the parking system. As a result, such time savings of the present invention reduces the waiting time of a user at the entrance to the parking system, thus being convenient for the user. Furthermore, in the present invention, the vehicle transport apparatus directly transports the vehicle from the outside into the parking system or from the parking system to the outside, thus being more convenient for the user.

Furthermore, the vehicle transport apparatus of the present invention has a small and simple structure. Therefore, the incidence of malfunction and operational error is reduced, and installation cost and maintenance cost are reduced. In addition, because the apparatus travels using a motor and lifts or puts down the vehicle using the hydraulic device, vibration and noise are prevented from occurring during operation.

DETAILED DESCRIPTION OF THE INVENTION

Figure 1:
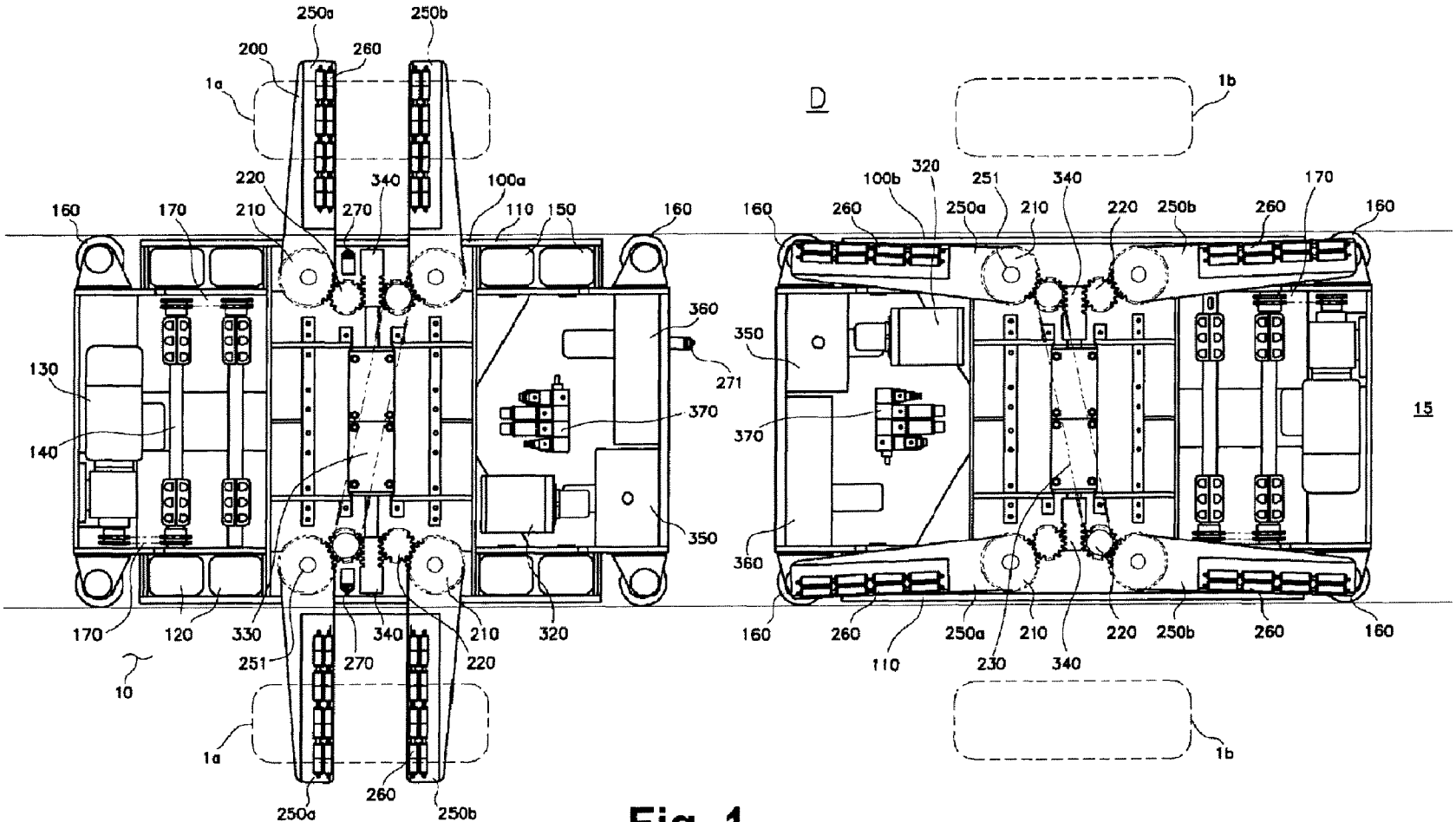
FIG. 1 is a plan view of a vehicle transport apparatus, according to the present invention.

Hereinafter, a preferred embodiment of the present invention which realizes the above objects will be described in detail with reference to the attached drawings. In the description of the preferred embodiment, the same reference names and the same reference numerals will be used to designate the same or similar components, and further explanation will be omitted.

The apparatus and method according to the present invention are for inclusion in an automatic parking system or equipment, and are used for automatically transporting vehicles to desired parking places in the parking system.

Figure 2:
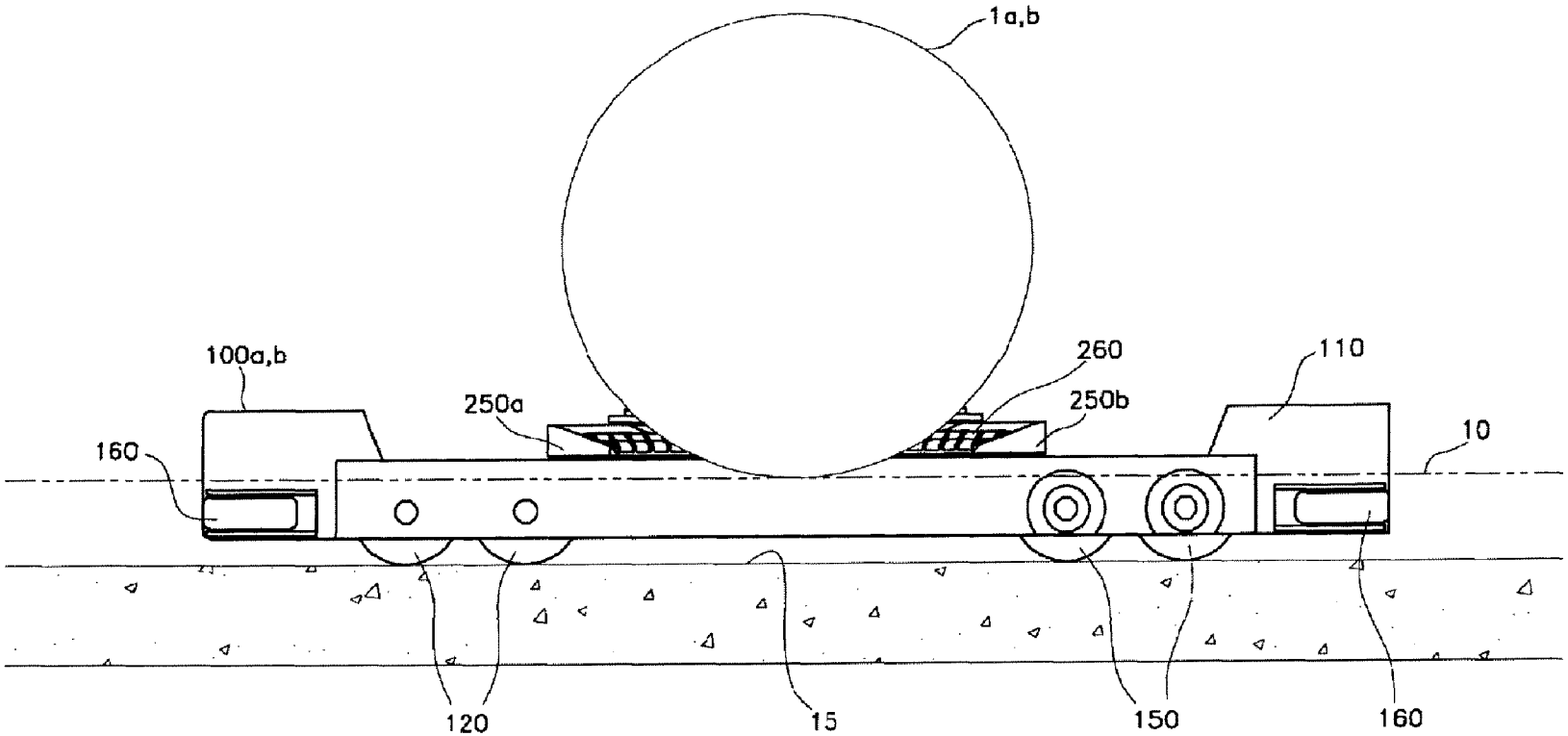
FIGS. 2 and 3 are front views showing the vehicle transport apparatus of FIG. 1.
Figure 3:
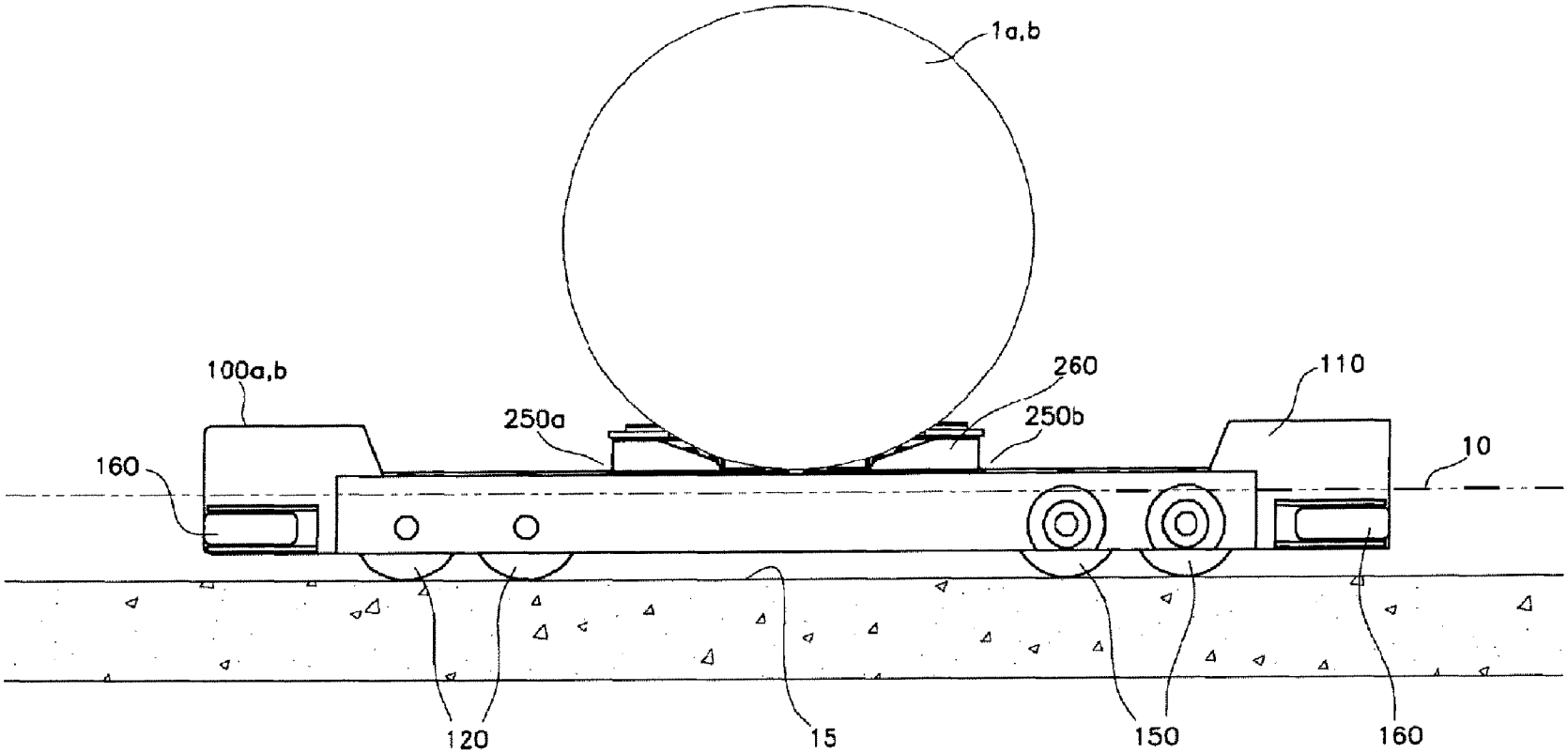
Figure 4:
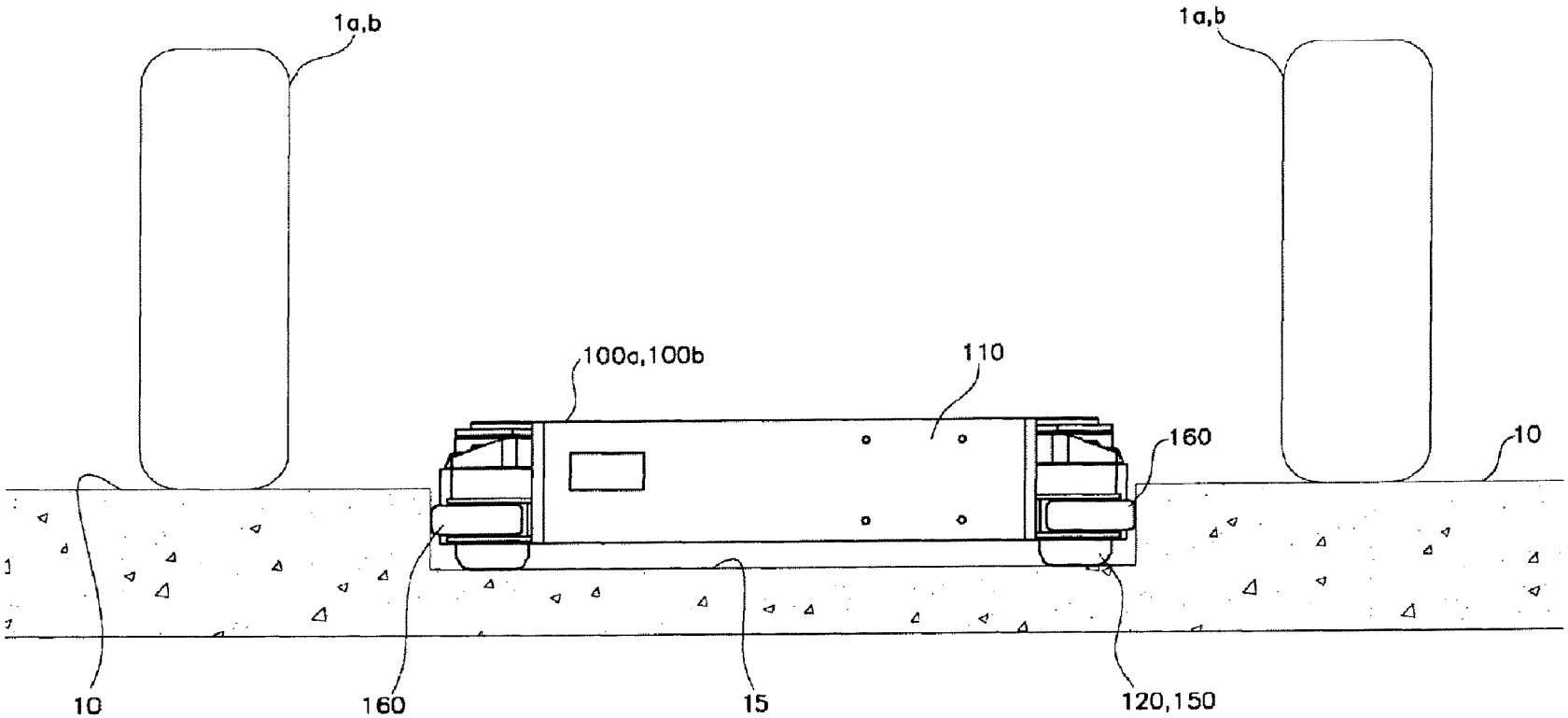
FIGS. 4 through 6 are side views showing the vehicle transport apparatus of FIG. 1.
Figure 5:
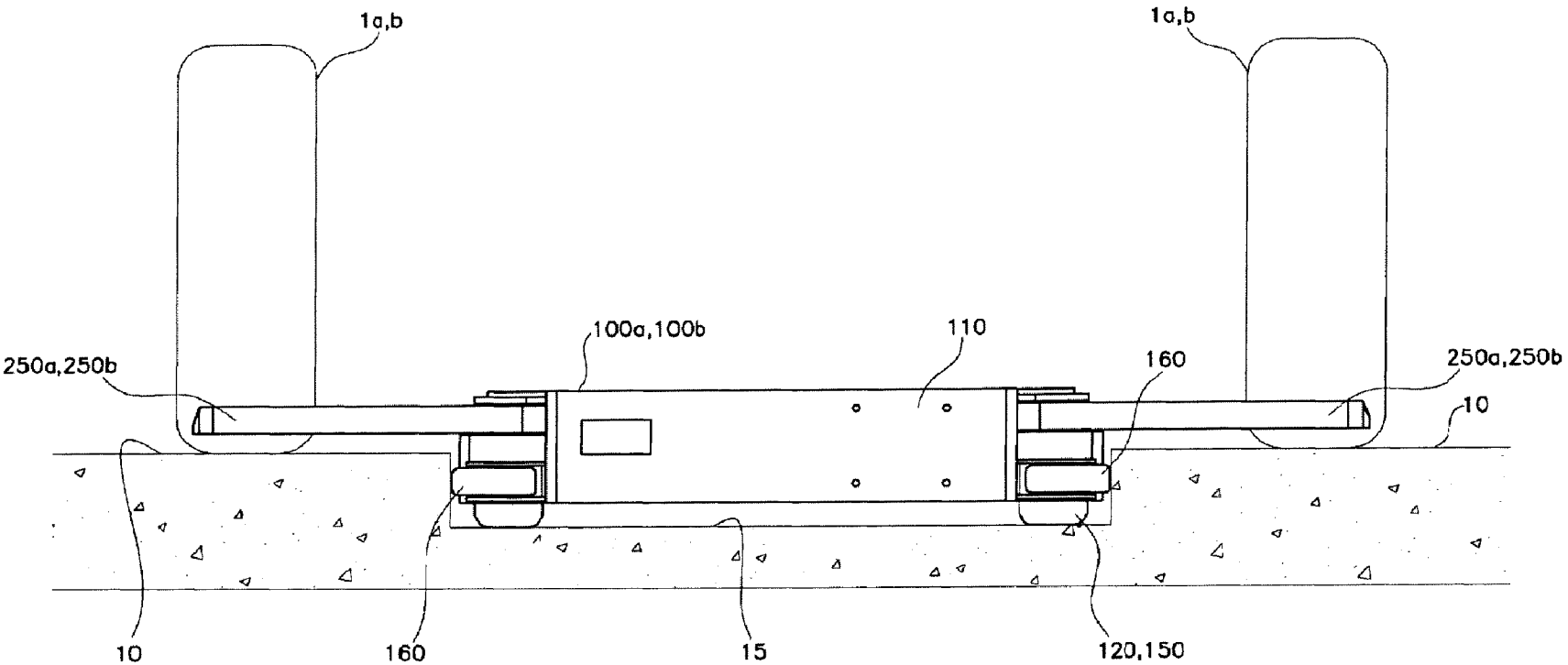
Figure 6:
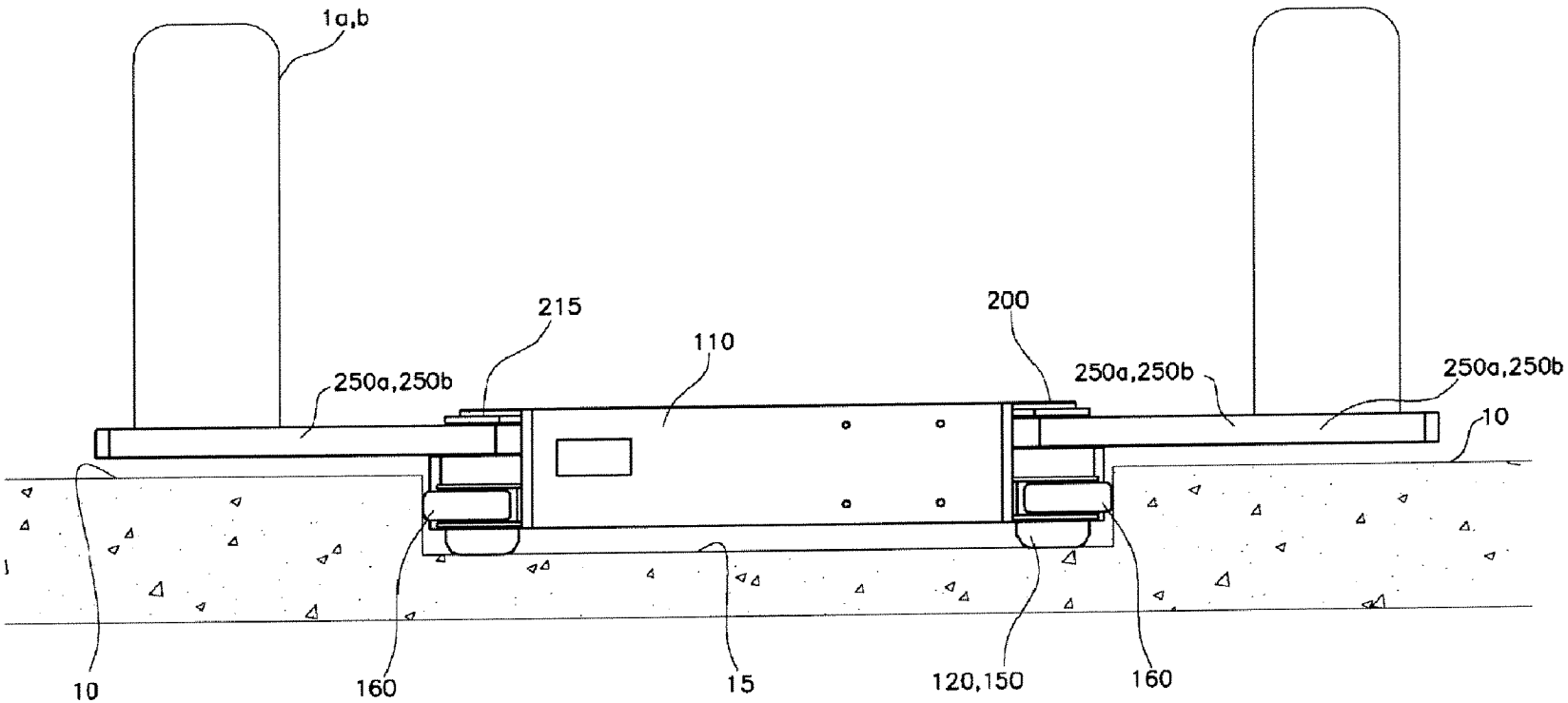

FIG. 1 is a plan view of a vehicle transport apparatus, according to the present invention. FIGS. 2 and 3 are front views showing the vehicle transport apparatus of the present invention. FIGS. 4 through 6 are side views showing the vehicle transport apparatus of the present invention. For reference, in FIGS. 1 through 6, only wheels a and b of a vehicle 1 are depicted to make the drawings clear. Here, the reference character 1*a* denotes a front wheel of the vehicle, and the reference character 1*b* denotes a rear wheel. The present invention will be explained in detail herein below with reference to the above drawings.

As shown in FIG. 1, the vehicle transport apparatus D of the present invention includes a pair of carriers 100*a* and 100*b*, which move among platforms 10, supporters 200 which are provided in the carriers 100*a* and 100*b*, and hydraulic devices 300 which operate the supporters 200.

The pair of carriers 100*a* and 100*b*, that is, the first carrier 100*a* and the second carrier 100*b* can independently move on the platforms 10. Each carrier 100*a*, 100*b* includes a main frame 110, to which various components are mounted. The main frame 110 has sufficient strength to support the weight of the vehicle and is designed such that various components can be installed therein.

Furthermore, each main frame 110 is able to move on the platforms 10 using a drive unit provided in the main frame 110. For this, the main frame 110 includes a plurality of drive wheels 120 which are connected to each other through both drive shafts 140 and chains 170. The drive shafts 140 are rotated by a power unit, for example, by a geared motor 130, so that the main frame 110 is moved by the rotation of the drive wheels 120 using the geared motor 130.

To secure stable movement of the main frame 110, a plurality of skid wheels 150 is mounted to the main frame 110. When the main frame 110 moves on the platforms 10, the skid wheels 150 are in rolling contact with the bottoms of the platforms 10 and support the main frame 110. In the embodiment of the present invention, preferably, at least two adjacent drive wheels 120 and at least two adjacent skid wheels 150 are mounted to each carrier and are arranged in the driving direction of the carrier. In this case, when the carrier moves between two adjacent platforms, at least two adjacent drive wheels 120 and at least two adjacent skid wheels 150 make it possible for the carrier to move over a gap between the platforms without noise and vibration. Furthermore, there is an effect of dispersion of the weight of the carrier. As well, thanks to the reduced diameter of the drive wheels and the skid wheels, there is the advantage of the reduced height of the carrier.

Figure 11:
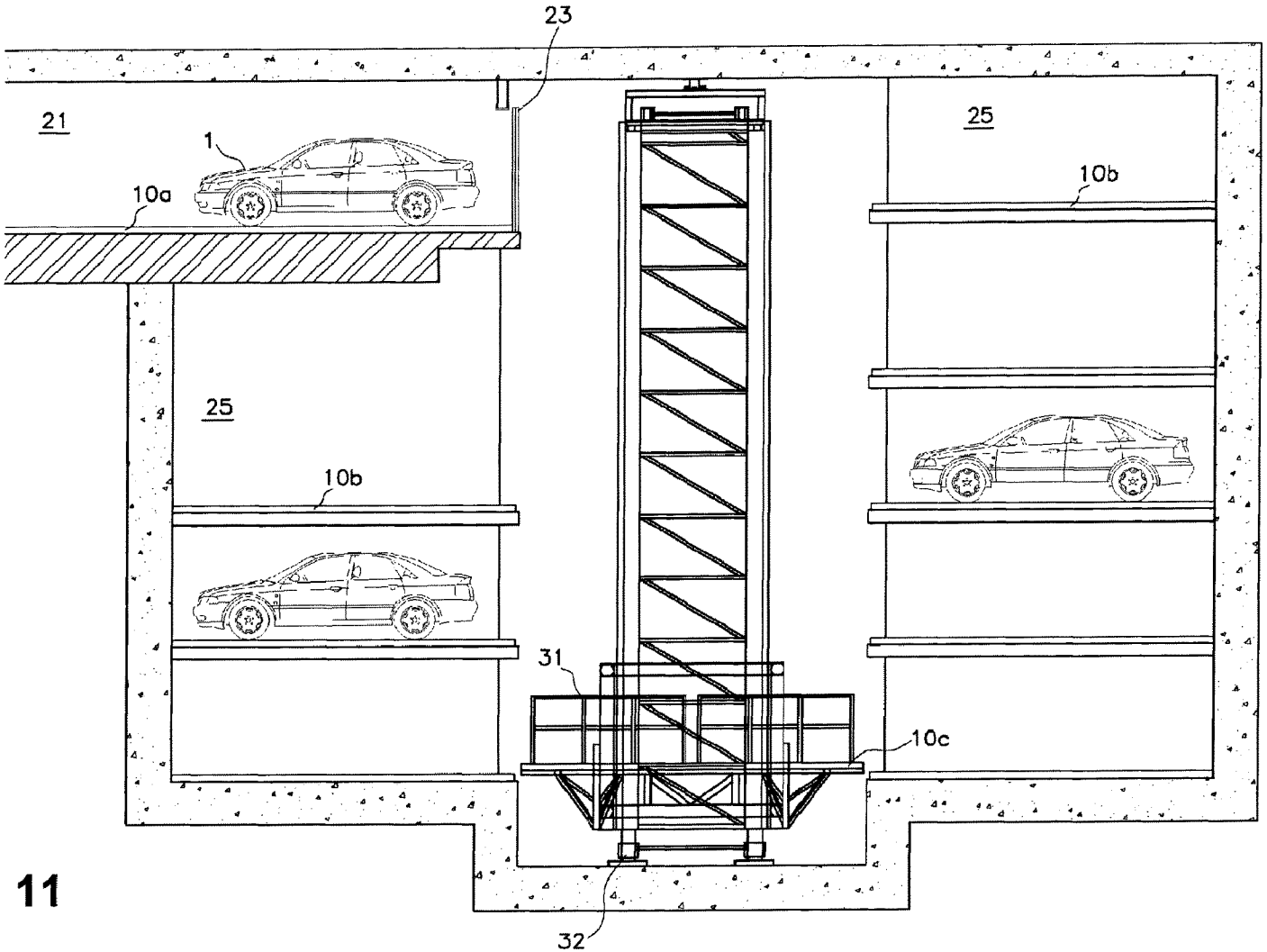
FIGS. 11 and 12 respectively are a sectional view and a plan view showing a parking system according to the present invention.
Figure 12:
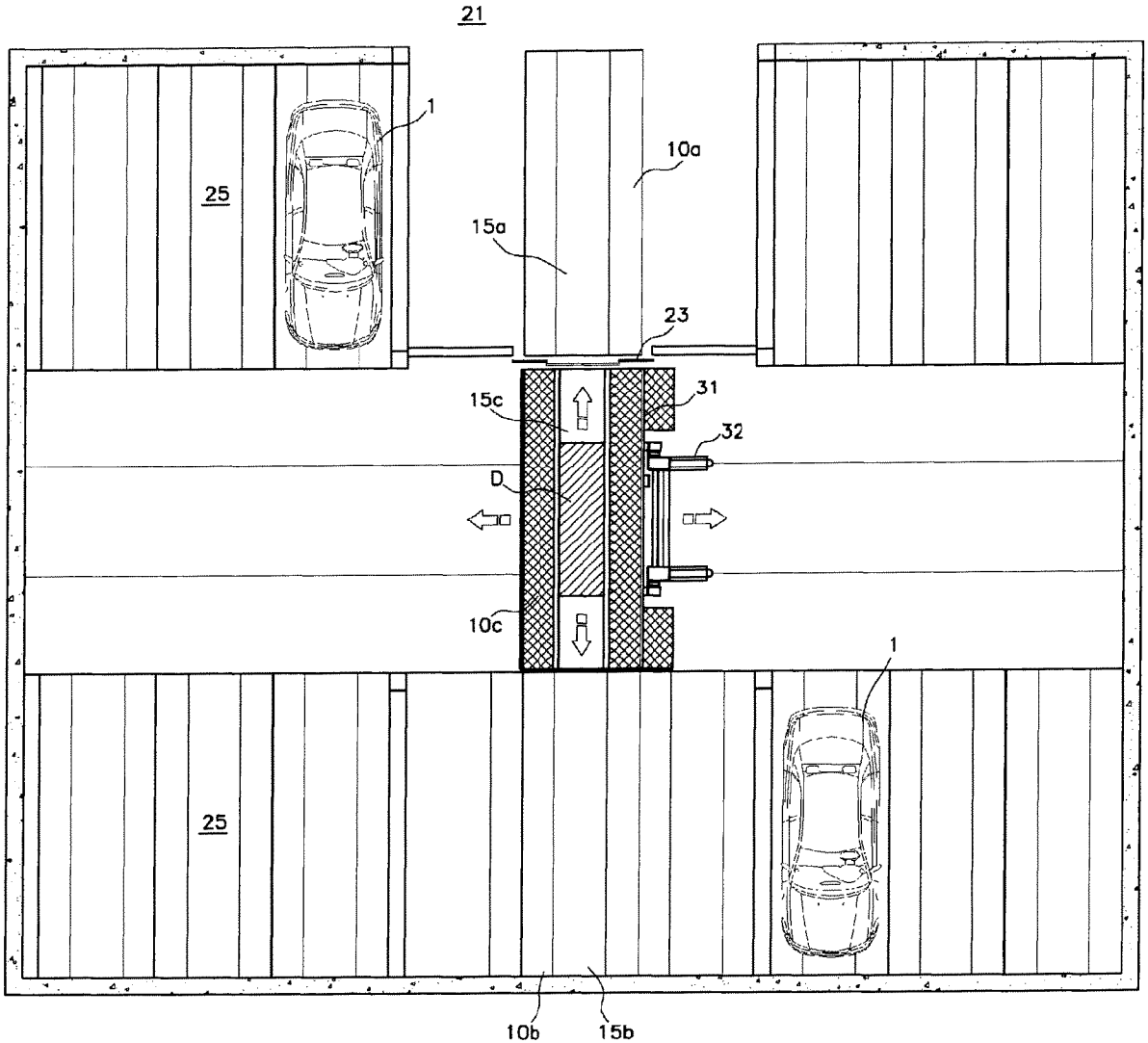
Figure 13:
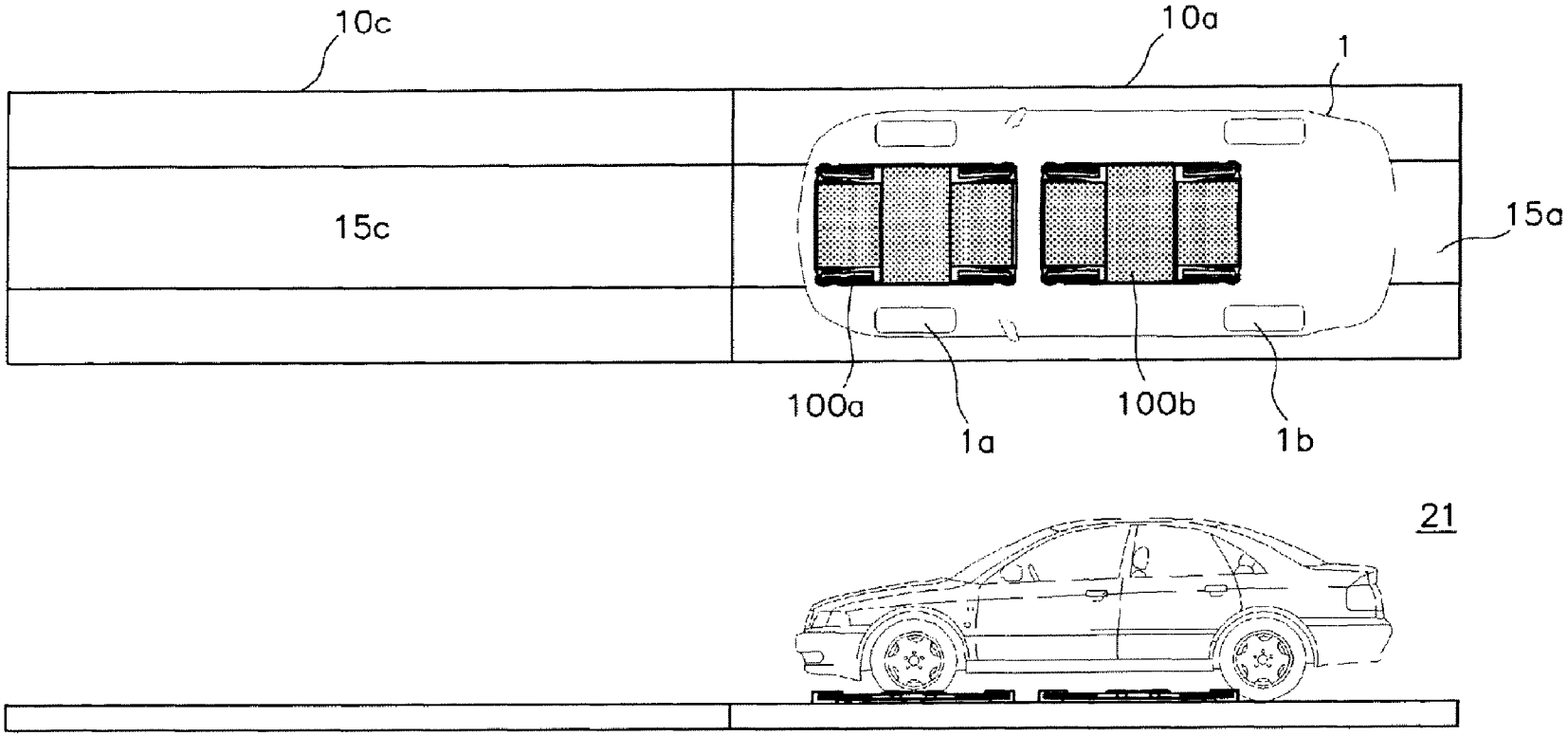
FIGS. 13 through 19 are schematic views showing steps of a method of automatically transporting vehicles, according to an embodiment of the present invention.

Each carrier 100*a*, 100*b* having the above-mentioned construction reciprocates among platforms 10 which may be coupled in a line. Here, as shown in FIGS. 11 and 12, one platform 10 is provided at the entrance 21 of a parking system, such that the platform 10 is standing by to receive a vehicle 1. A platform 10 is provided in each parking space 25, which is defined in the parking system and in which the vehicle is parked. As such, the platforms 10 are a kind of stage on which the vehicle 1 is placed. Hereinafter, as necessary, the platform provided at the entrance 21 will be called a first platform 10*a*, and the platform provided in each parking space 25 will be called a second platform 10*b*.

Meanwhile, in the case that the entrance 21 of the parking system in which the vehicle 1 to be parked is standing by is far away from the parking space 25 in which the vehicle 1 is to be parked, a separate platform 10 may be provided in an apparatus for carrying the vehicle 1 from one place to another place, for example, as shown in FIG. 11, it may be provided in a lift 31 which vertically moves between several floors in the parking system, or, as shown in FIG. 12, it may be provided in a carrying device 32, which horizontally moves on one floor in the parking system. Therefore, the platform, which is provided in the carrying device 31 or 32 for carrying the vehicle 1 in the parking system, can move between the first platform 10*a* and the second platform 10*b* and be selectively connected to the first platform 10*a* or the second platform 10*b*. Hereinafter, as necessary, the platform provided in the above-mentioned carrying device will be called a third platform 10*c*.

Each such platform 10 includes a passage 15, through which the carriers 100*a* and 100*b* move, as shown in FIGS. 4 through 6. The passage 15 is concavely defined along a longitudinal center line in the bottom of each carrier 100*a*, 100*b*. The carriers 100*a* and 100*b* are movably placed in and guided by the passage 15. Furthermore, when the platforms 10 are connected to each other, the passages 15 of the platforms 10 communicate with each other. Thereby, the vehicle transport apparatus D of the present invention is movable from one platform to another platform through the passages 15.

Each carrier 100*a*, 100*b* further includes guide rollers 160 which guide the carrier 100*a*, 100*b* that linearly moves in the passages 15. As shown in FIGS. 4 through 6, the guide rollers 160 are provided in opposite sides of each main frame 110, so that the guide rollers 160 are in rolling contact with vertical side walls formed in the platforms 10, that is, sidewalls of the passages 15, thus guiding linear movement of the main frame 110.

Figure 7:
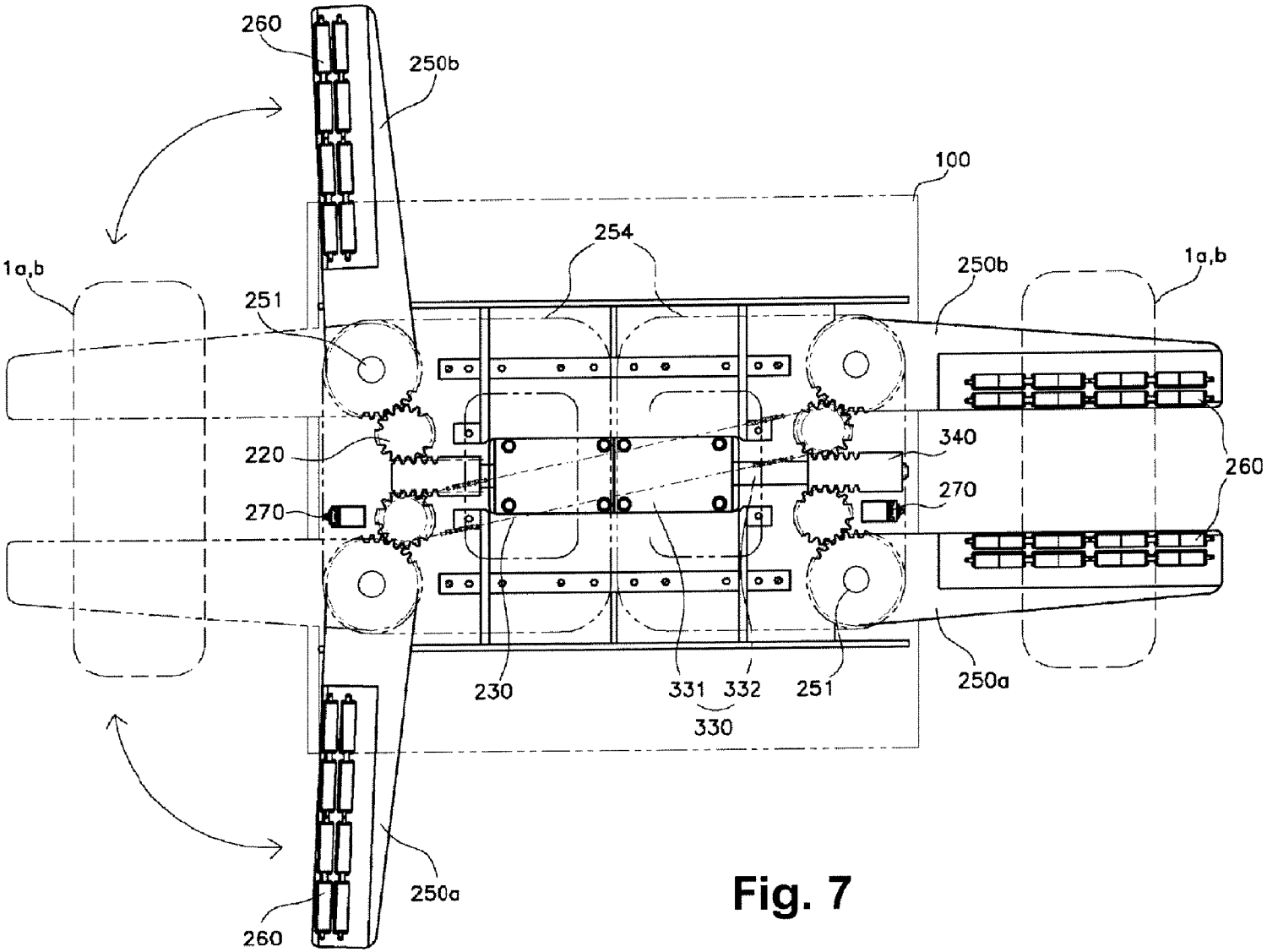
FIG. 7 is a plan view showing a supporter of the vehicle transport apparatus of FIG. 1 in detail.

Meanwhile, the supporters 200 are coupled to the main frame 110. A pair of arms 250 constituting each supporter is provided at each of the opposite sides of each carrier 100*a*, 100*b*. The arms 250 are rotatable outwards from the opposite sides of the carrier 100*a*, 100*b*, so that the arms 250 lift wheels of the vehicle 1, placed on the platform 10, or put them down on the platform. In FIGS. 5 and 7, the structure of the supporter 200 is illustrated in detail. Hereinafter, the supporter will be explained in detail with reference to these drawings.

As shown in FIGS. 5 and 7, the supporter 200 includes arms 250*a* and 250*b* which horizontally rotate and are thus extracted outwards from the main frame 110 so that the arms 250*a* and 250*b* engage with the wheels 1*a* or 1*b* of the vehicle 1. In other words, the arms 250*a* and 250*b* are constructed such that they are extracted outwards from the opposite sides of the main frame 110 by their rotation. One pair of arms 250*a* and 250*b*, which face each other when the arms 250*a* and 250*b* are completely extracted by rotation, push the lower front portion and the lower rear portion of one wheel 1*a* or 1*b* inwards, thus lifting the wheel 1*a* or 1*b* from the bottom of the platform 10. Furthermore, the arms support the wheel, which is lifted from the bottom of the main frame. Here, the surface of each arm 250*a*, 250*b* which contacts the wheel 1*a* or 1*b* is inclined for ease of contact with the wheel 1*a* or 1*b* and for reduction in friction, as shown in FIGS. 2 and 3. Preferably, a plurality of rollers 260, which are able to rotate without restriction, is provided in each inclined surface of each arm in order to minimize frictional resistance between the wheel and the arms 250. In this embodiment of the present invention, the rollers are mounted to a rotating shaft, which is mounted to the inclined surface of each arm, in a row. It is preferable that the rollers be disposed in each arm in two or three rows parallel with the longitudinal direction of the arm.

As shown in FIG. 1, two pairs of arms 250*a* and 250*b* are provided in each carrier 100*a*, 100*b*. Thus, each carrier 100*a*, 100*b* can lift and support two wheels at opposite sides thereof using the pushing force of rotation of the arms. That is, one carrier 100*a* or 100*b* lifts and transports two wheels of the vehicle 1, for example, one pair of front wheels 1*a* or rear wheels 1*b*, and the remaining carrier 100*a* or 100*b* lifts and transports the remaining wheels of the vehicle 1, for example, the remaining pair of wheels among the front wheels 1*a* and the rear wheels 1*b*.

As such, of one pair of arms 250*a* and 250*b*, which contact one wheel 1*a* or 1*b*, the first arm 250*a* and the second arm 250*b* simultaneously rotate and respectively contact the front and rear portions of the wheel 1*a* or 1*b*. The first arm 250*a* and the second arm 250*b* further rotate to positions perpendicular to the main frame 110, so that the wheel 1*a* or 1*b* is moved to the upper surfaces of the arms 250 by the rotating force of the arms 250, thus being lifted from the bottom of the platform 10. At this time, the wheel 1 can easily move to the upper surfaces of the arms 250*a* and 250*b* thanks to the rollers 260, which are rotatably mounted to the upper surfaces of the arms 250*a* and 250*b* that contact the wheels 1*a* and 1*b*.

Furthermore, when one pair of arms 250*a* and 250*b* pushes the lower front portion and the lower rear portion of one wheel inwards and thus lift and support the wheel, the arms 250*a* and 250*b* are parallel with each other, so that the wheel can be stably lifted and supported by the arms 250*a* and 250*b*. At this time, as shown in FIG. 7, each arm 250*a*, 250*b* is at an approximately right angle to each sidewall of the main frame 110.

As shown in FIG. 7, in each carrier 100*a*, 100*b*, the rotation of each arm 250*a*, 250*b* to the position perpendicular to the main frame 110 is realized by an idle gear 220, mounted to the main frame 110 through a shaft 221. Therefore, when one pair of arms 250, which is provided at one side of the carrier, rotates, the other pair of arms 250*a* and 250*b*, which are provided at the other side of the carrier, must simultaneously rotate. As such, in order to simultaneously operate the arms 250*a* and 250*b*, which are at opposite sides of the carrier, and to rotate them at the same angle, the associated idle gears 220 are coupled to each other by a chain 230.

Figure 8:
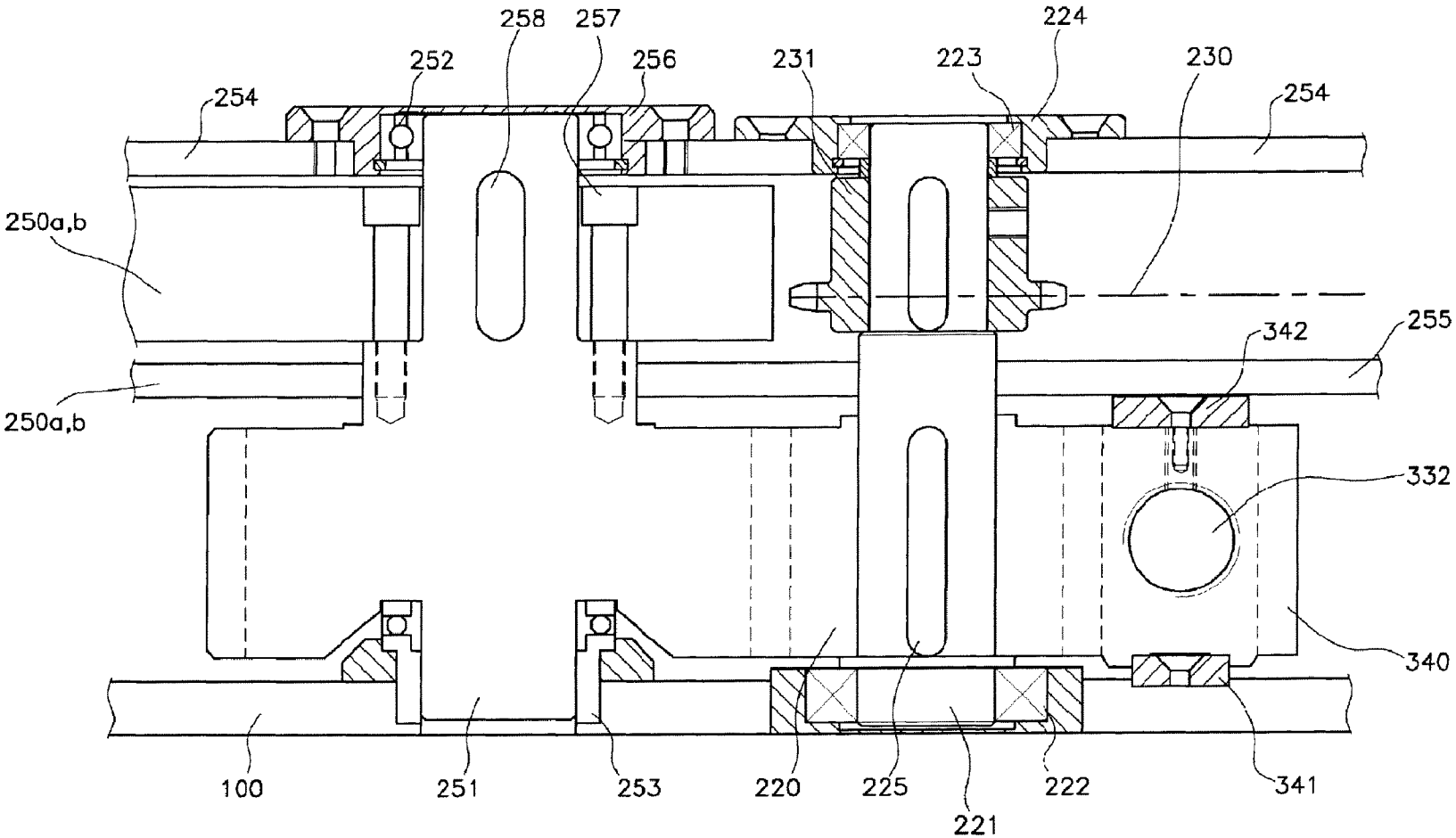
FIGS. 8 through 10 are partial sectional views showing the supporter of FIG. 7.
Figure 9:
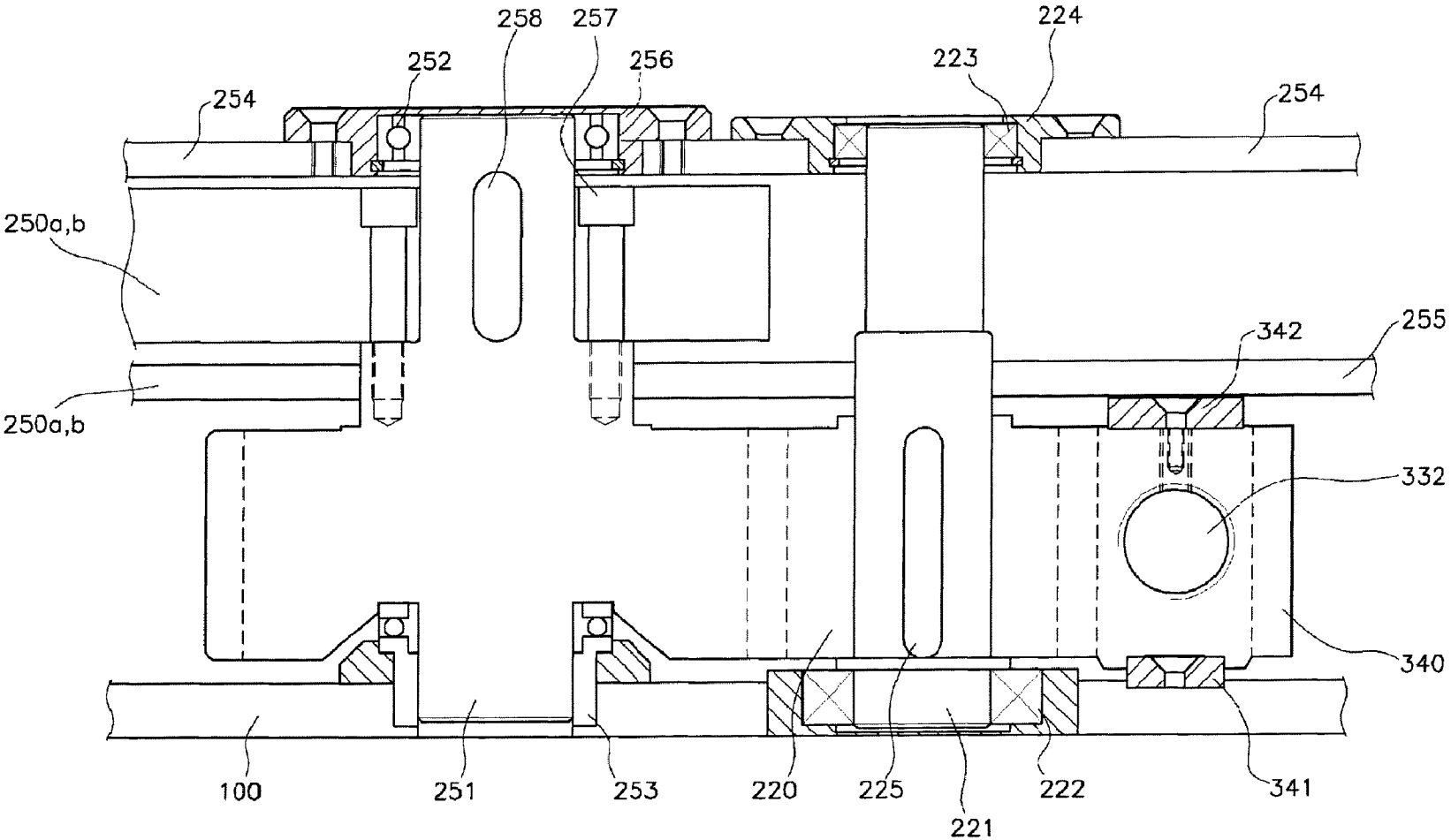

Meanwhile, as shown in FIGS. 1 and 7, the arms 250*a* and 250*b*, which support the wheels 1*a* and 1*b* of the vehicle 1, are operated by hydraulic cylinders 330 and rack gears 340. For this, as shown in FIGS. 8 and 9, rotating shafts 251 each having a pinion gear are perpendicularly coupled to both a first support plate 254 and a second support plate 255 in the supporter 200, in detail, in the main frame 110. Each arm 250*a*, 250*b* is coupled to each rotating shaft 251 such that the arm 250*a*, 250*b* is horizontally rotated by the rotation of the rotating shaft 251. The idle gears 220 and the rack gears 340 are provided among the arms 250*a* and 250*b* and the hydraulic cylinders 330.

Furthermore, as shown in FIGS. 8 and 9, each arm 250*a*, 250*b* is securely coupled to the rotating shaft 251 by both a locking bolt 257 and a key 258, such that rotating force is reliably transmitted from the rotating shaft 251 to the arm 250*a*, 250*b*. As well, each rotating shaft 251 is mounted both through the first support plate 254 and through the second support plate 255 so as to ensure smooth rotation and sufficient strength thereof. As shown in FIG. 8, a thrust bearing 253 supports the lower end of the rotating shaft 251 which passes through the first and second support plates 254 and 255, such that the rotating shaft 251 can endure a vertical load while rotating. Furthermore, a radial bearing 252 is provided on the upper end of the rotating shaft 251 which passes through the arms 250*a* and 250*b*, so as to prevent the rotating shaft 251 from shaking in a horizontal direction. The radial bearing 252 is disposed in a cover 256. The cover 256 is fastened to the first support plate 254.

As shown in FIG. 8, the idle gear 220, which is coupled to the rotating shaft 251 and rotates the rotating shaft 251, is mounted to the shaft 221 by a key 225, such that rotating force is reliably transmitted. Furthermore, the shaft 221 is mounted both through the first support plate 254 and through the second support plate 255 so as to ensure smooth rotation and sufficient strength thereof. As shown in FIG. 8, the lower end of the shaft 221 which passes through the first and second support plates 254 and 255 is supported by a thrust bearing 222, so that the shaft 221 can endure a vertical load while rotating. Furthermore, a radial bearing 223 is provided on the upper end of the shaft 221 which passes through the idle gear 220, thus preventing the shaft 221 from shaking in a horizontal direction. The radial bearing 223 is disposed in a cover 224. The cover 224 is fastened to the first support plate 254.

To simultaneously rotate one pair of arms 250*a* and the other pair of arms 250*b*, a sprocket 231 is provided at an intermediate position on some shaft 221. In detail, as shown in FIG. 8, a sprocket 231 is provided on one of the shafts 221 of the idle gears 220, which rotate one pair of arms 250, and the other sprocket 231 is provided on one of the shafts 221 of the idle gears 220, which rotate the other pair of arms 250. The sprockets 231 are connected to each other by the chain 230, thus synchronizing the arms.

Meanwhile, as shown in FIG. 7, the hydraulic cylinders 330 are provided in the supporters 200, in detail, between the main frame 100 and the arms 250*a* and 250*b* and control the rotation of the arms 250*a* and 250*b*. For this, the idle gears 220 and the rack gears 340 are rotatably coupled to the rotating shafts 251 of the arms 250*a* and 250*b*, as shown in FIG. 7. Each rack gear 340 is coupled to a rod 332 of each hydraulic cylinder 330. A cylinder body 331 of the hydraulic cylinder 330 to which the rod 332 is coupled is mounted to the main frame 110. Here, gear teeth are formed on some portions of opposite sidewalls of each rack gear 340, which is coupled to the cylinder rod 332. The upper and lower surfaces of the rack gear 340 are respectively supported by an upper guide 342, which is mounted to the second support plate 255, and a lower guide 341, which is mounted to the main frame 110, thus preventing the rack gear 340 from moving in a transverse direction while moving in the longitudinal direction of the hydraulic cylinder. The idle gears 220 engage with the opposite sidewalls of the rack gear 340. Thus, when the hydraulic cylinder 330 is operated by the supply of hydraulic oil, the cylinder rod 332 is extracted from the cylinder body 331.

Then, the rack gear 340 moves horizontally, so that the idle gears 220 are rotated, thus simultaneously rotating the arms 250*a* and 250*b*.

Figure 10:
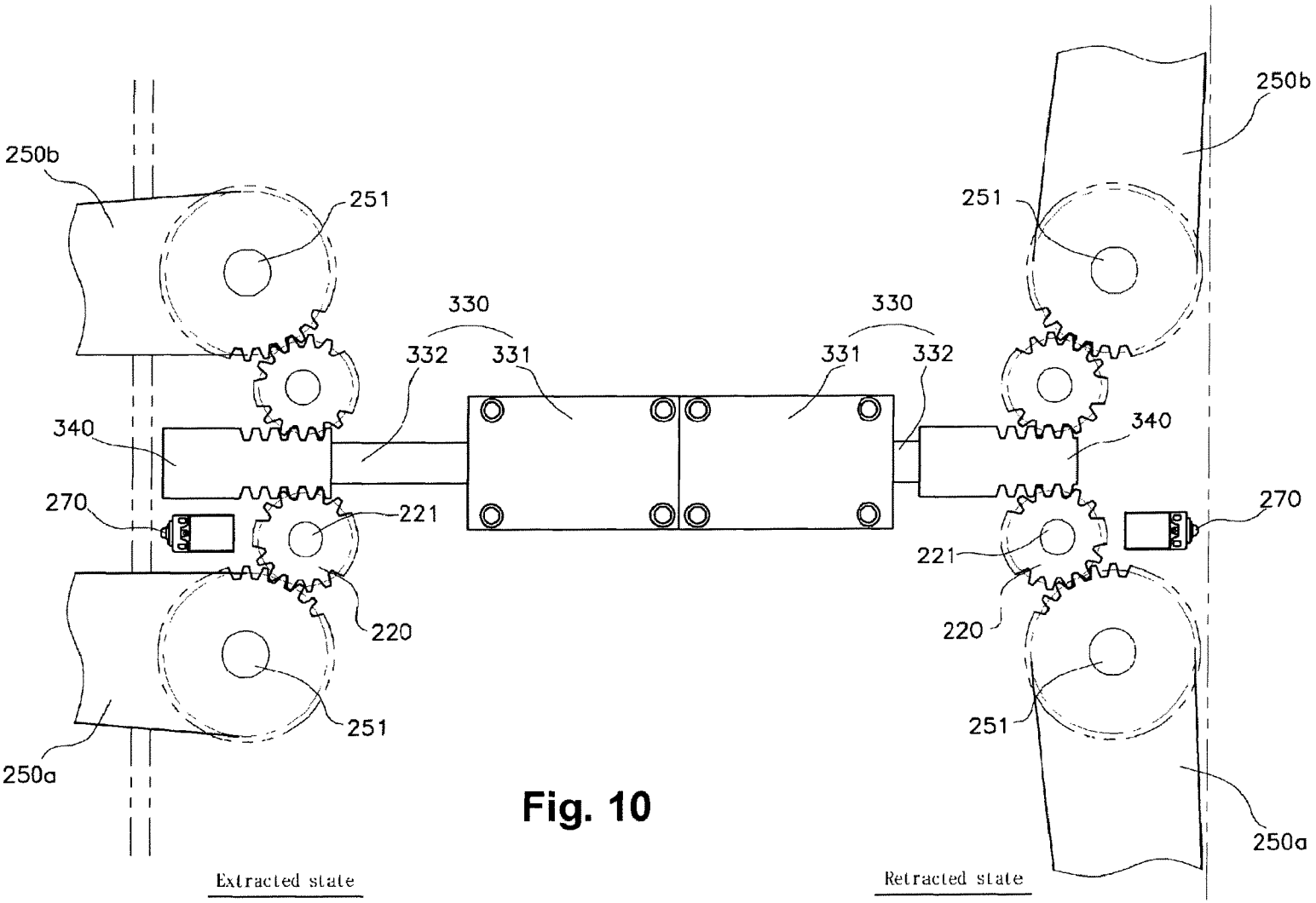

In each supporter 200 having the above-mentioned construction, while the hydraulic cylinder 330 is not operated, the cylinder rod 332 is in a state of being retracted into the cylinder body 331 and pulling the rack gear 340, as shown in FIG. 10. Therefore, while the hydraulic cylinder 330 is not operated, the arms 250*a*, 250*b* are not extracted outwards from the main frame 110, as shown in FIG. 10.

Conversely, when the hydraulic cylinder 331 is operated, the cylinder rod 332 is extracted outwards from the cylinder body 331 and thus pushes the rack gear 340 outwards, as shown in FIG. 10. As a result, when the hydraulic cylinder 330 is operated, the arms 250*a* and 250*b* are rotated around the rotating shaft 251 in a direction parallel with the main frame 110, thus being extracted outwards from the main frame 100.

In the vehicle transport apparatus D of the present invention, the main frame 110 and the supporters 200, which are provided in each carrier 100*a*, 100*b*, are driven by one hydraulic device. To achieve the above-mentioned purpose, as shown in FIG. 1, an oil tank 350, which stores hydraulic oil therein, and a hydraulic pump 320, which is coupled to the oil tank 350 and generates hydraulic pressure, are mounted in each carrier 100*a*, 100*b*, in detail, in each main frame 110. A hydraulic valve 370, which adjusts the pressure and direction of the hydraulic oil to be supplied to the hydraulic cylinders 330, is connected to the hydraulic pump 320. That is, the operation of the arms 250*a* and 250*b* is controlled both by the hydraulic cylinders 330 and by the hydraulic pressure adjusted by the hydraulic valve 370. Moreover, as shown in FIG. 1, an accumulator 360 is provided between the hydraulic pump 320 and the hydraulic valve 370, such that two hydraulic cylinders 330 can be simultaneously rapidly operated.

Figure 20:
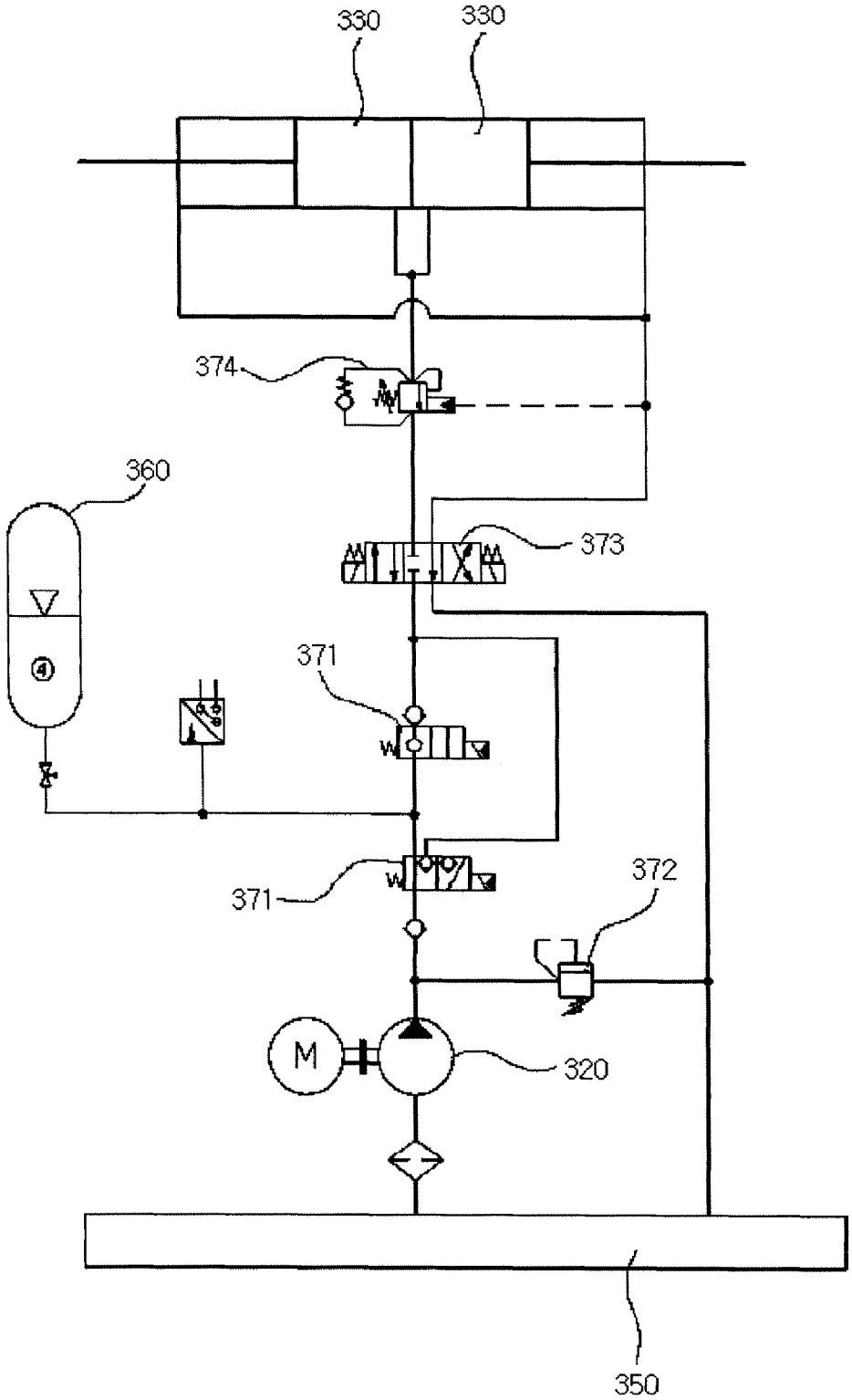
FIG. 20 is a schematic view of a hydraulic system used in the vehicle transport apparatus according to the present invention. Best Mode for Carrying Out the Invention

FIG. 20 is a distribution diagram of a hydraulic system used in the embodiment of the present invention. Hereinafter, the operation of the hydraulic system to drive the arms according to the present invention will be explained with reference to FIG. 20. The hydraulic system shown in FIG. 20 includes the oil tank 350, the hydraulic pump 320 having a motor, the accumulator 360, which stores therein oil in the state of being compressed by gas, solenoid valves 371 and 372, which can open and close as desired, a relief valve 372, which discharges oil at a predetermined pressure or higher, thus reducing the pressure, a hydraulic pressure control valve 374, which maintains the hydraulic pressure in the cylinders when power is interrupted, and the hydraulic cylinders 330.

First, the operation of the hydraulic system when the arms are extracted in order to lift the wheels of the vehicle will be explained herein below. The hydraulic pump 320 coupled to the motor is operated and, simultaneously, the solenoid valves 371 and 373 and the hydraulic pressure control valve 374 are opened in a direction that advances the cylinders 330. At this time, oil, which has been in the accumulator 360 and has been compressed by gas such as nitrogen at a predetermined pressure, is discharged at high speed, thus operating the hydraulic cylinders 330. As a result, the arms are rapidly rotated. Here, the arms are rotated at high speed by the pressure of the oil discharged from the accumulator until the arms are brought into contact with the wheels of the vehicle. Thereafter, when the arms are brought into contact with the wheels, a valve of the accumulator is closed. After this, the hydraulic cylinders are operated by the hydraulic pump 320 at high pressure to lift the wheels of the vehicle. When the wheels of the vehicle are lifted by the arms, which are completely extracted, the solenoid valves, which are connected to the hydraulic cylinder, are closed, and the valve of the accumulator is opened. Thus, the hydraulic pump charges the accumulator until the pressure in the accumulator reaches a desired pressure. After the accumulator is charged to the desired pressure, the hydraulic pump is stopped. Meanwhile, when it is desired to retract the arms and put down the wheels of the vehicle, the hydraulic pump is operated and, simultaneously, the solenoid valves 371 and 373 and the hydraulic pressure control valve 374 open in a direction that retracts the hydraulic cylinders. Thus, when the wheels of the vehicle are brought into contact with the surface of the carrier by the rotation of the arms, the valve of the accumulator 360 is opened, so that the oil, which was in the accumulator due to gas pressure, is discharged at high speed but at a pressure lower than the hydraulic pump, thus rapidly retracting the hydraulic cylinder 330. Thereby, the arms are rapidly retracted into the carrier. When the arms are completely retracted, the solenoid valves coupled to the hydraulic cylinders are closed, but the valve of the accumulator is opened. Then, the hydraulic pump charges the accumulator until the pressure in the accumulator reaches a desired pressure. After the accumulator is charged to the desired pressure, the hydraulic pump stops.

According to the present invention, in the state in which the weight of the vehicle is not applied to the arms, that is, before the arms are brought into contact with the wheels in the process of lifting the vehicle and after the wheels are brought into contact with the platform in the process of putting down the vehicle, the arms are operated using the hydraulic oil of the accumulator which generates relatively weak operating force but ensures a rapid operating speed in place of using the hydraulic oil of the hydraulic pump which generates relatively strong operating force but reduces the operating speed of the arms. Thus, the present invention can efficiently enhance the operating speed of the vehicle transport apparatus and the processing capacity of the parking system.

Meanwhile, as described above, each of the carriers 100*a* and 100*b* lifts and transports one pair among the front wheels 1*a* or the rear wheels 1*b* of the vehicle 1. At this time, the carriers 100*a* and 100*b* must be located at precise positions, such that the arms 250*a* and 250*b* of each carrier 100*a*, 100*b* can stably lift one pair of the front wheels 1*a* or the rear wheels 1*b* of the vehicle 1. For this, the vehicle transport apparatus D of the present invention includes sensors 270 which detect the position of the wheels 1*a* and 1*b* of the vehicle 1. Hereinafter, this will be explained in detail.

As shown in FIGS. 1 and 10, the sensor 270 is provided in each supporter 200, in detail, between the arms 250*a* and 250*b*. Here, the sensor 270 uses light or ultrasound to detect the wheels 1*a* and 1*b* when the carriers 100*a* and 100*b* approach the wheels 1*a* and 1*b*. In this case, after the sensor 270 detects the wheels 1*a* or 1*b*, if each carrier 100*a*, 100*b* stops after a predetermined time has passed in consideration of movement speed, the supporter 200 can be stopped at a position at which it is aligned with the wheels 1*a* or 1*b*. In the embodiment of the present invention, preferably, a distance maintenance sensor (271 of FIG. 1) is provided in one of the carriers 100*a* and 100*b* so as to measure the distance between the two carriers, thus maintaining the distance between the two carriers constant while operating. Then, even if there is no unit which couples the two carriers to each other, the distance between the two carriers is maintained constant while the two carriers move from one platform to another platform to transport the vehicle.

To lift the wheels 1*a* and 1*b* of the vehicle 1 at precise positions, the vehicle transport apparatus D of the present invention comprising sensors 270 having the above-mentioned structure detects the wheels 1*a* and 1*b* of the vehicle 1 through the following method.

First, the supporters 200 of one carrier are spread near one pair of the front or rear wheels 1*a* or 1*b* of the vehicle 1 and then engage with and lift them. Here, because the vehicle 1 is placed at a preset position on the platform 10, when one carrier is stopped at a preset position, the supporter 200 can be precisely positioned at a precise position to lift the wheels.

Thereafter, the remaining carrier moves towards the remaining pair of the front and rear wheels 1*a* and 1*b* of the vehicle 1. Here, the distance between the first carrier and the second carrier has been maintained at a predetermined distance shorter than the distance between the front wheels and the rear wheels of the vehicle during normal conditions. After the position of the first carrier is determined, the second carrier moves in a direction moving away from the first carrier, the position of which was previously determined, and detects the remaining wheels using the sensor 270 provided in the second carrier. After the sensor 270 of the second carrier detects the wheels 1*a* or 1*b*, when the center of the arms 250*a* and 250*b* is aligned with the center of the wheels 1*a* or 1*b* after a predetermined time has passed, the second carrier is stopped. Thereafter, the supporters 200 of the second carrier are spread and thus contact and lift the remaining pair of the front and rear wheels 1*a* and 1*b* of the vehicle, so that the vehicle can be stably transported. At this time, to prepare for when the center of the arms 250*a* and 250*b* of the supporters 200 is not precisely aligned with the center of the remaining wheels 1*a* or 1*b*, when the arms 250*a* and 250*b* are extracted, a brake of a geared motor, which is braking the second carrier, is released, so that the center of the arms 250*a* and 250*b* of the second carrier naturally become aligned with the center of the wheels 1*a* or 1*b*.

FIGS. 11 and 12 respectively are a sectional view and a plan view showing the parking system of the present invention. FIGS. 13 through 19 are schematic views showing steps of a method of automatically transporting vehicles according to the present invention. Hereinafter, the vehicle transport method according to the present invention will be described with reference to FIGS. 13 through 19.

As shown in FIG. 11, if the vehicle 1 to be parked is placed on the first platform 10*a* at the entrance 21 of the parking system, the vehicle transport apparatus D moves to the first platform 10*a*. In other words, a driver stops the vehicle on the first platform 10*a* at the entrance 21 of the parking system and, thereafter, requests that the vehicle be parked in the parking system using a control panel, which is provided in the entrance. At this time, it is important for the driver to place the wheels 1*a* and 1*b* of the vehicle 1 at desired positions such that the vehicle transport apparatus D can easily lift the vehicle. Thereafter, the parking system, having received the request, opens a door 23, which is provided in the entrance 21, and moves the vehicle transport apparatus D to the first platform 10*a*, which is located outside the parking system.

Typically, the parking system has a large number of parking spaces 25, as shown in FIGS. 11 and 12. Thus, the entrance 21 is spaced apart from each parking space 25. Therefore, in the parking system of the present invention, the above-mentioned carrying devices 31 and 32 having the third platform 10*c* are used to transport the vehicle 1 from the entrance 21 to a desired parking space 25 or in a reverse direction. In detail, the parking system moves the third platform 10*c* to the entrance 21 using the carrying devices 31 and 32. Then, the third platform 10*c* is connected to the first platform 10*a* such that their passages 15*a* and 15*c* communicate with each other when the door 23 is opened. As described above, the passages 15*a* and 15*c* are to ensure movement of the vehicle transport apparatus D and are respectively defined in the first and third platforms 10*a* and 10*c*. Subsequently, the door 23 of the entrance 21 is opened, and the vehicle transport apparatus D moves from the third platform 10*c* onto the first platform 10*a* below the vehicle 1 through the passages 15*c* and 15*a*. Here, the vehicle transport apparatus D is moved both by the geared motor 140 and by the drive wheels 120, which are rotatably coupled to the geared motor 140.

Figure 14:
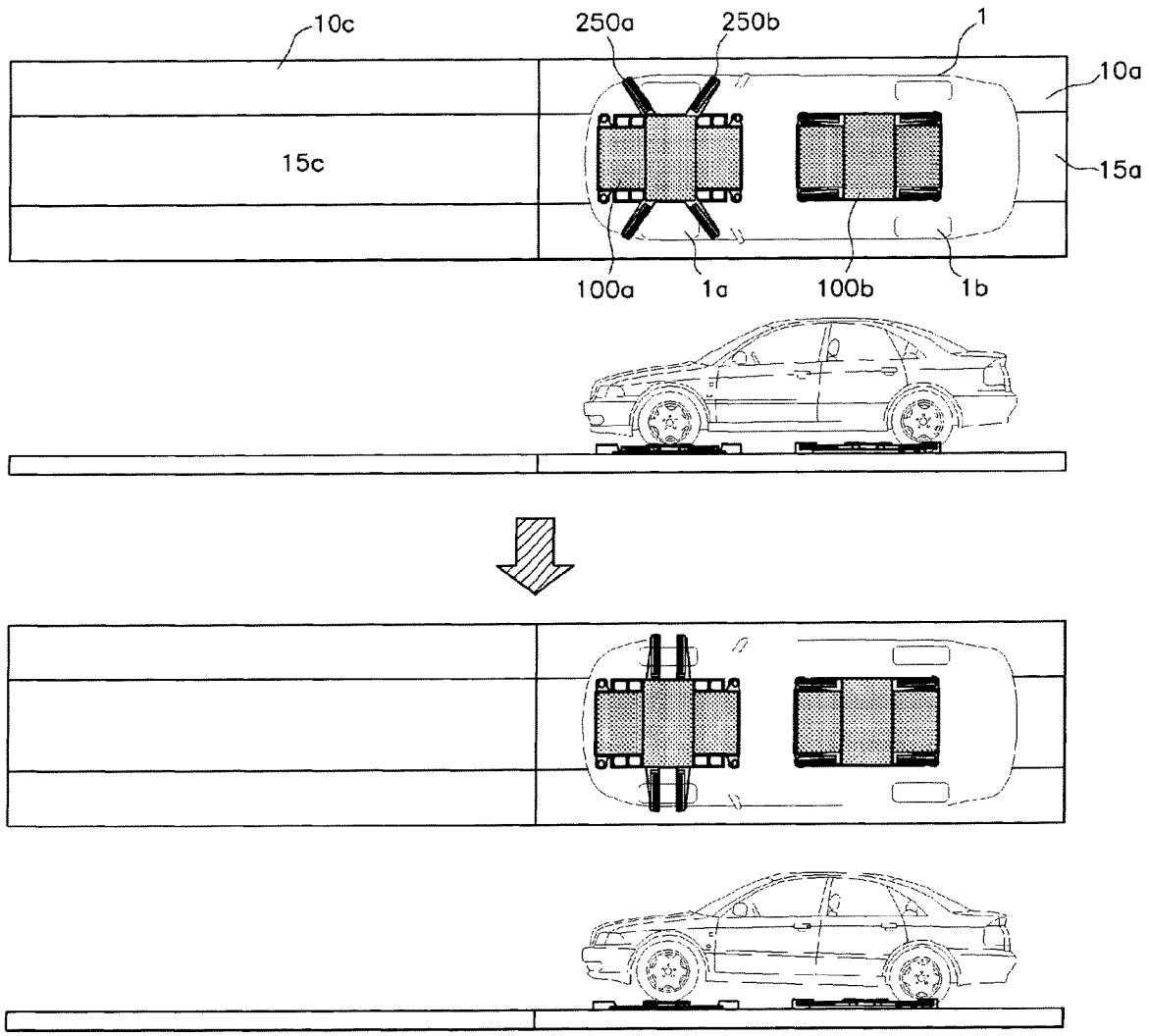

As such, after the vehicle transport apparatus D moves onto the first platform 10*a*, the vehicle transport apparatus D lifts two wheels of the vehicles 1 placed on the first platform 10*a*, for example, it lifts one pair of front wheels 1*a* or rear wheels 1*b*, as shown in FIG. 14.

For reference, presently, most vehicles are front wheel drive vehicles. If a front wheel drive vehicle is in a state of being in gear, it is hard to rotate its front wheels. Furthermore, when front wheels of most of vehicles are steered to the left or right, a handle is locked. Therefore, it is preferable that the first carrier 100*a* of the vehicle transport apparatus D first lift the front wheels 1*a* of the vehicle 1 from the first platform 10*a*.

As such, under control of the parking system, the supporters 200 of the first carrier 100*a* hold, engage with and lift the front wheels 1*a* of the vehicle 1 such that the wheels are placed on the arms 250. To conduct the above-mentioned operation, the rods 322 of the hydraulic cylinders 330 of the first carrier 100*a* push the rack gears 340 outwards. Each rack gear 340 rotates the idle gears 220. Then, the arms 250*a* and 250*b* of the first carrier 100*a* horizontally rotate around the rotating shafts 251, thus being extracted outwards from the opposite sides of the vehicle transport apparatus D, as shown in FIG. 14. As a result, the arms 250*a* and 250*b* are brought into contact with the front and rear portions of the front wheels 1*a* of the vehicle 1, thus lifting the front wheels from the bottom. Then, the front wheels 1*a* of the vehicle 1 are lifted from the bottom of the first platform 10*a*, while the rear wheels 1*b* are supported on the bottom of the first platform 10*a*.

Figure 15:
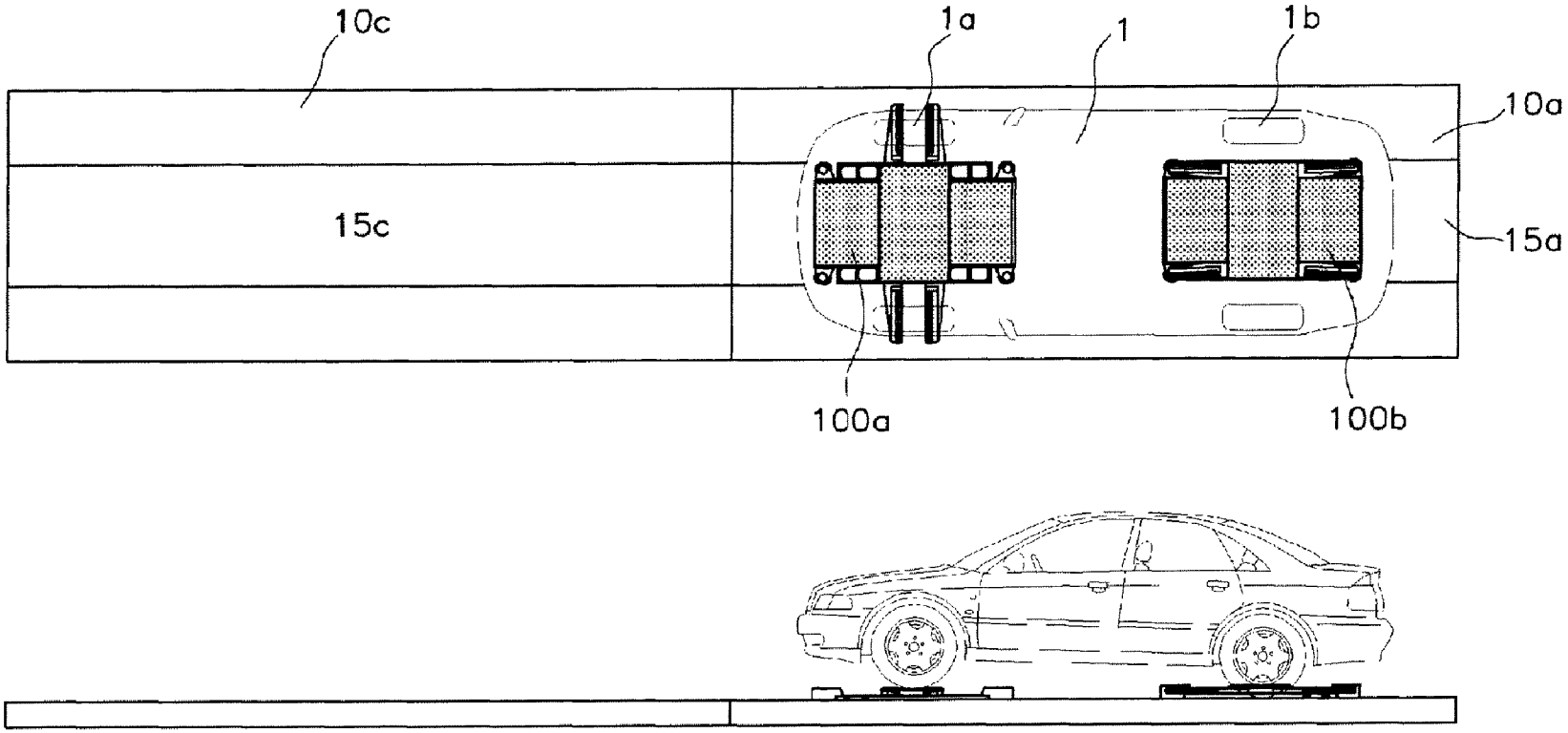
Figure 16:
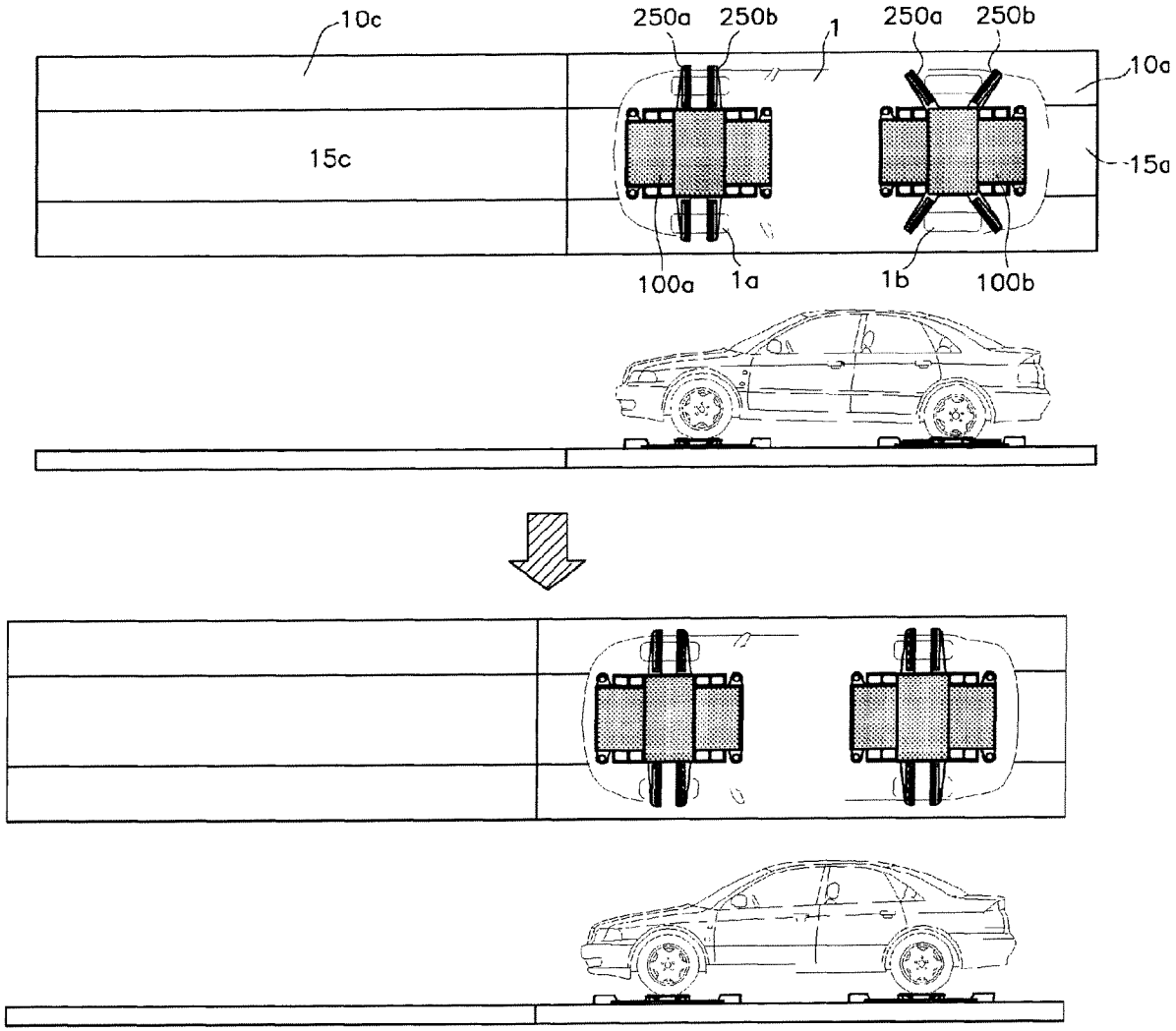
Figure 17:
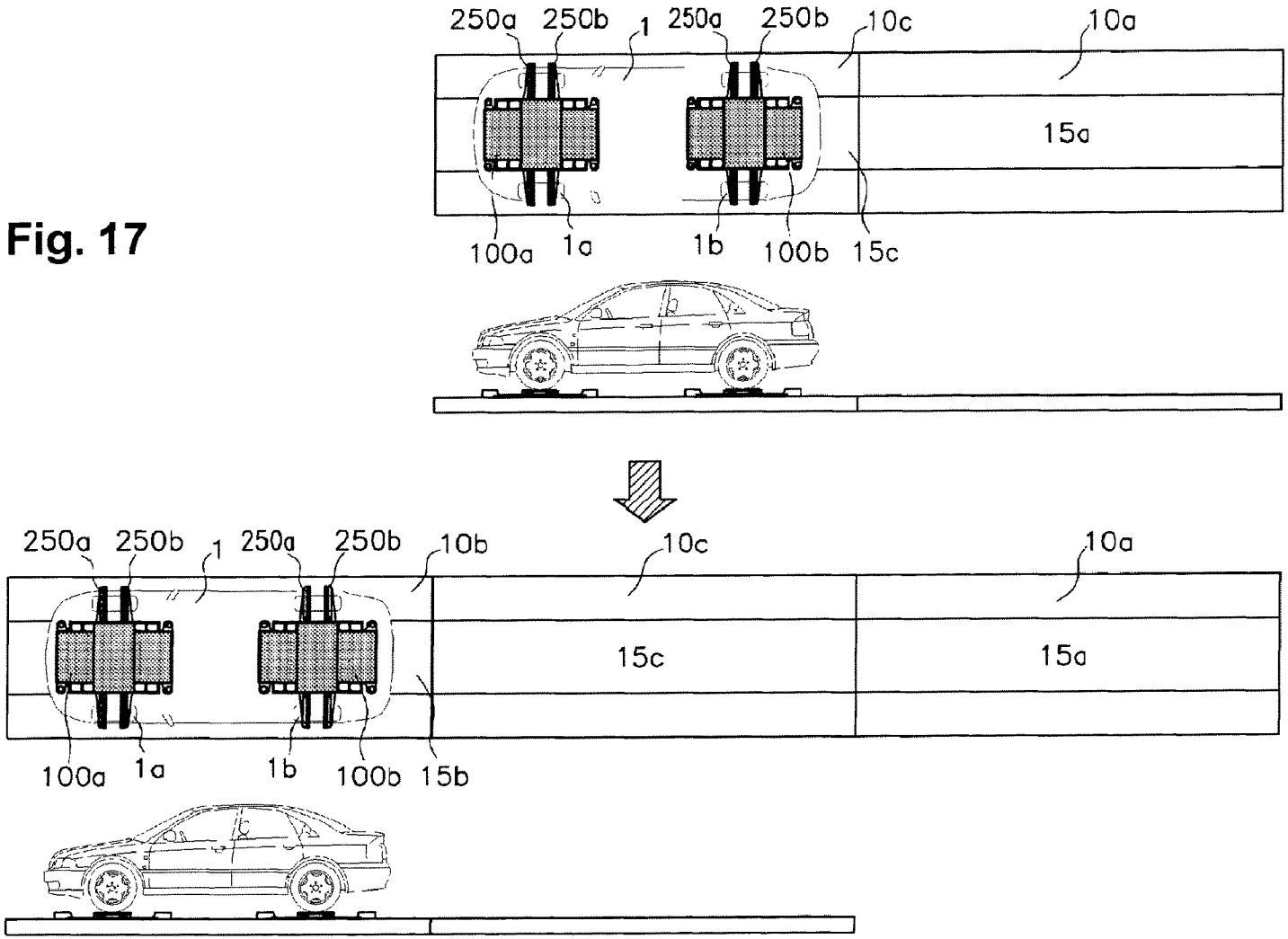

After the first carrier 100*a* lifts the front wheels 1*a* of the vehicle 1, the parking system moves the second carrier 100*b* towards the rear wheels 1*b* of the vehicle, as shown in FIG. 15. At this time, the second carrier 100*b* finds the position of the rear wheels 1*b* so that the second carrier 100*b* can precisely locate itself beside the rear wheels 1*b* while approaching the rear wheels 1*b* of the vehicle 1. That is, the sensors 270, which are provided on the supporters 200, detect the rear wheels 1*b* of the vehicle 1 and, thereafter, the second carrier 100*b* is stopped at the center of the rear wheels after a predetermined time has passed.

Subsequently, the arms 250*a* and 250*b*, having moved along with the second carrier 100*b*, are horizontally rotated, so that the arms 250*a* and 250*b* engage with the rear wheels 1*b* of the vehicle 1 and push them inwards, thus lifting the rear wheels 1*b* from the bottom of the first platform 10*a*.

As such, after the wheels of the vehicle 1, that is, the front wheels 1*a* and the rear wheels 1*b*, are placed onto the vehicle transport apparatus D by the hydraulic device 300, the vehicle transport apparatus D, on which the vehicle 1 is placed, moves to a second platform 10*b* provided in a desired parking space 25 in the parking system.

To conduct the above-mentioned operation, first, the vehicle transport device D moves the vehicle 1 from the first platform 10*a* to the third platform 10*c*, which is provided in the carrying devices 31 and 32 and is connected to the first platform 10*a*. That is, because the third platform 10*c* is connected to the first platform 10*a* while the door 23 of the parking system is in a state of being opened, the vehicle transport device D can be moved along the passages 15*a* and 15*c*, which communicate with each other, under the control of the parking system.

Thereafter, the carrying devices 31 and 32 transport the vehicle transport apparatus D with the vehicle 1 from the first platform 10*a* towards the desired second platform 10*b*. When the third platform 10*c* reaches the desired parking space 25 using the carrying devices 31 and 32, the third platform 10*c* is connected to the second platform 10*b* such that the passages 15*c* and 15*b* communicate with each other. Typically, the parking space 25, in which the second platform 10*b* is provided, is in an open state. During such a transport process, because it is not necessary to put down the vehicle 1 on the third platform 10*c*, the vehicle 1 is maintained in a state of being lifted by the vehicle transport apparatus D.

When the third platform 10*c* is connected to the second platform 10*b* by the carrying devices 31 and 32, the vehicle transport apparatus D moves from the third platform 10*c* to the second platform 10*b* through the passages 15*b* and 15*c*, which communicate with each other.

Figure 18:
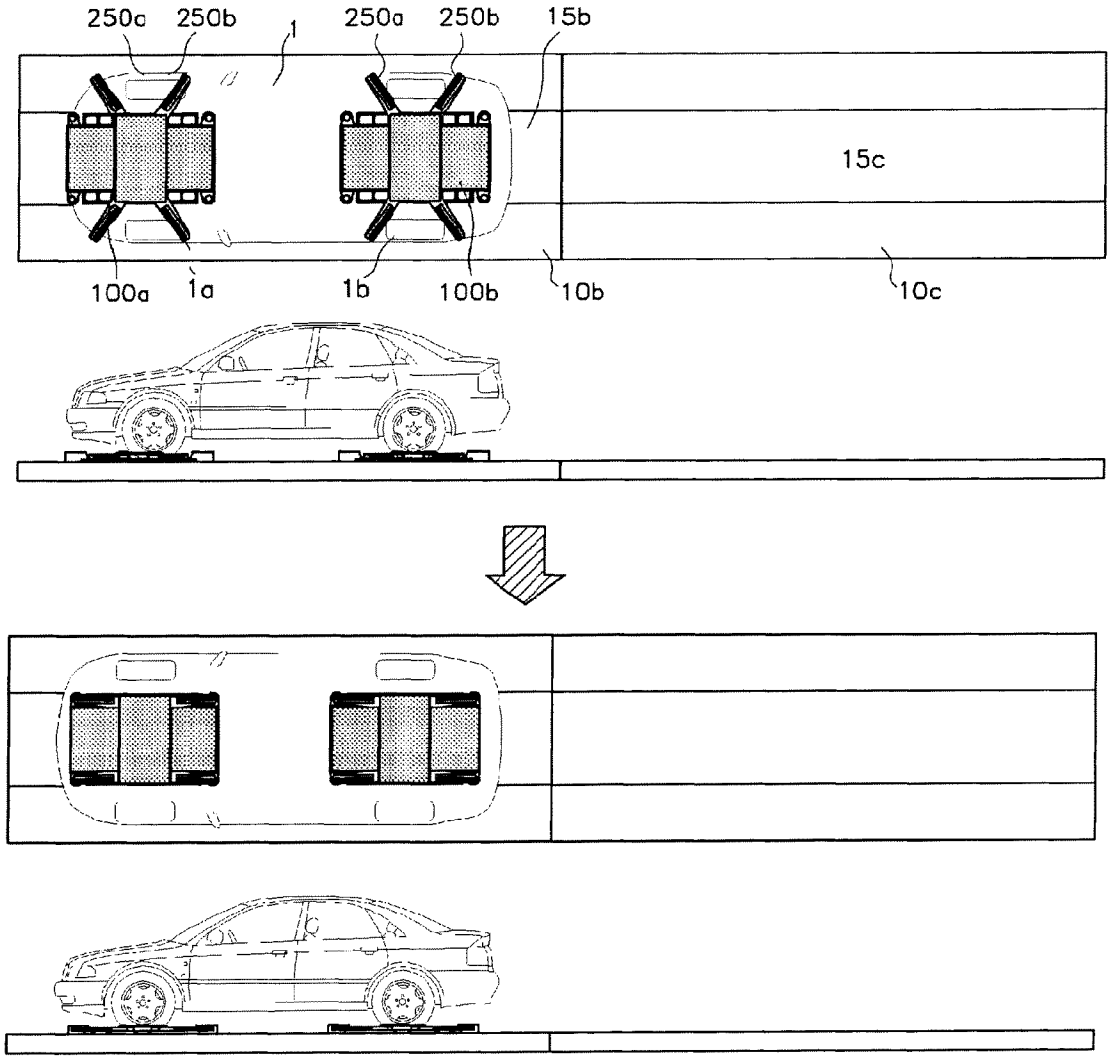
Figure 19:
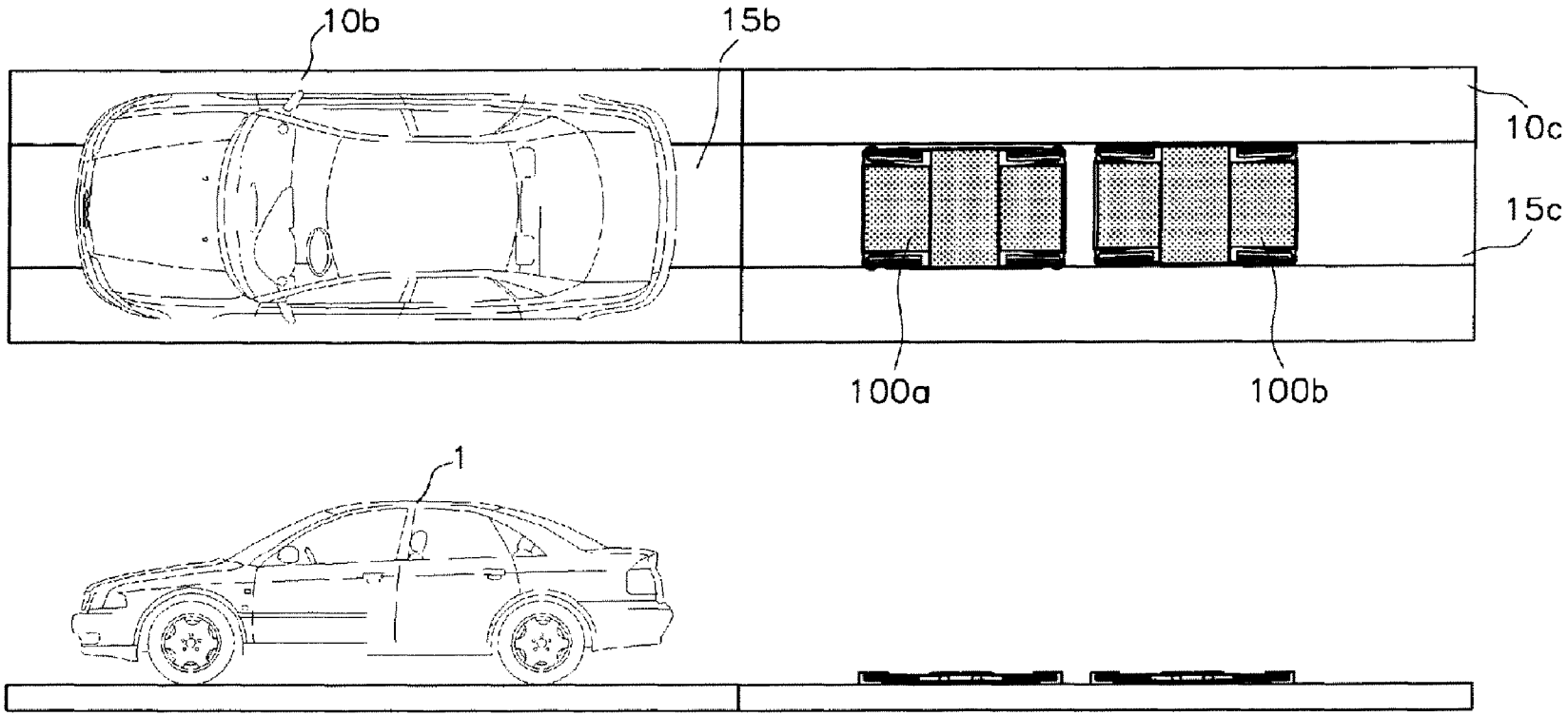

After the vehicle transport apparatus D is located on the second platform 10*b* along with the vehicle 1, the vehicle transport apparatus D puts the vehicle 1 down onto the second platform 10*b*, as shown in FIG. 18. For this, the arms 250*a* and 250*b* are rotated in a reverse direction, that is, they are slowly rotated towards the main frames 110, thus being moved away from the wheels. Then, the wheels of the vehicle 1 descend and are brought into contact with the bottom of the second platform 10*b*. Finally, the wheels are supported on the second platform 10*b*, and the arms 250*a* and 250*b* are completely retracted into the carriers 100*a* and 100*b*, as shown in FIG. 18.

Meanwhile, to carry the vehicle 1, which is being parked in the parking space 25, out of the parking system, the above-explained process is conducted in reverse. In detail, the vehicle 1 is lifted and carried from the second platform 10*b* to the third platform 10*c* of the carrying devices 31 and 32 by the vehicle transport apparatus D. The third platform 10*c* with the vehicle 1 is thereafter moved towards the first platform 10*a* in the entrance 21 of the parking system by the carrying devices 31 and 32. Thereafter, the vehicle 1 is carried from the third platform 10*c* to the first platform 10*c*. Subsequently, the vehicle 1 is put down on the first platform 10*c* so that the driver may drive it. The motion of the vehicle transport apparatus during the process of removing the vehicle 1 is the same as that during the parking process, therefore further explanation is deemed unnecessary.

Meanwhile, after the parking process is completed, the vehicle transport apparatus D is preferably returned to the third platform 10*c*. The reason is that because the third platform 10*c* of the carrying devices 31 and 32 is located between the first and second platforms 10*a* and 10*b*, if the vehicle transport apparatus D is placed on the third platform 10*c*, the vehicle transport apparatus D can rapidly move to the first or second platform 10*a* or 10*b* when a parking or removal process is required. For the same reason, after the removal process is completed, the vehicle transport apparatus D must be also returned to the third platform 10*c*.

Although the embodiment, in which the first platform 10*a* is provided in the entrance 21 of the parking system and the third platform 10*c* is provided in the carrying devices 31 and 32, has been explained, the present invention is not limited to this. For example, the first platform 10*a* may be provided in the carrying devices 31 and 32. In this case, the third platform 10*c* is not provided. When it is desired to park the vehicle, the driver locates the vehicle 1 on the platform provided in the carrying devices 31 and 32 placed inside the door 23. To remove the vehicle from the parking system, the driver moves to the platform of the carrying devices 31 and 32 placed inside the door 23 and removes the vehicle 1 from the parking system.

Although the preferred embodiments of the present invention have been disclosed for illustrative purposes, those skilled in the art will appreciate that various modifications, additions and substitutions are possible, without departing from the scope and spirit of the present invention. Furthermore, the above-disclosed embodiments are merely examples for description of the present invention but do not mean that the present invention is limited to them. Therefore, the present invention may be variously modified within the bounds of the accompanying claims, without being limited to the above-mentioned embodiments.

What is claimed is:

1. A vehicle transport apparatus for parking systems, comprising: a first platform from which a lifted vehicle to be parked is inserted into a parking system; a second platform provided in a parking space for the vehicle; and a pair of carriers moving between the first platform and the second platform, wherein each carrier comprises: a main frame; at least one drive wheel provided in the main frame so that the carrier is movable; a drive motor rotating said at least one drive wheel; at least two pairs of arms rotatably mounted to each of opposite sides of the main frame; and a hydraulic device rotating the arms between extracted positions and retracted positions of the arms, wherein each of said at least two pairs of arms lift a wheel of the vehicle when the pair of arms are extracted from the main frame by the hydraulic device, and contact surfaces of each of said at least two pairs of arms, which engage with the wheel when the pair of arms are extracted, comprise inclined surfaces based on a horizontal plane, and a plurality of rollers having rotating shafts parallel with a longitudinal direction of each arm is disposed in the inclined surfaces of the pair of arms in two or more rows, and wherein each carrier of the pair of carriers independently moves between the first platform and the second platform using said at least one drive wheel being driven by the drive motor, wherein each said arm is supported by a rotating shaft mounted on the main frame such that the arm is horizontally rotated with respect to the main frame, and the rotating shaft is rotated by an idle gear to be rotated by a rack gear coupled to the hydraulic device, and wherein a first idle gear for rotating an arm of a first pair of said at least two pairs of arms for lifting a wheel located on one side of the main frame is connected with a second idle gear for rotating an arm of a second pair of said at least two pairs of arms for lifting another wheel located at the opposite side of the main frame so that the first pair of arms and the second pair of arms are rotated at a same angular velocity in a synchronized manner, and wherein the hydraulic device comprises: an oil tank provided in the carrier and storing hydraulic oil therein; a hydraulic pump coupled to the oil tank and generating hydraulic pressure; a plurality of hydraulic cylinders rotating the arms using the hydraulic pressure generated from the hydraulic pump; a hydraulic valve provided among the hydraulic pump and the hydraulic cylinders and adjusting a pressure and a direction of the hydraulic oil to be supplied to the hydraulic cylinders; and an accumulator storing the hydraulic oil supplied from the hydraulic pump in a compressed state, thus realizing rapid rotation of the arms: and wherein the accumulator stores the hydraulic oil in the compressed state using compressed gas, so that, when the arms are extracted to lift the wheels of the vehicle, the accumulator discharges the stored hydraulic oil at high speed such that the arms are rapidly extracted to desired angles before the arms lift the wheels of the vehicle using a driving force of the hydraulic cylinders by the hydraulic pump, and, when the arms are retracted to put down the wheels of the vehicles, the arms are retracted to desired angles using driving force of the hydraulic cylinders and, thereafter, the accumulator discharges the stored hydraulic oil at high speed such that the arms are rapidly retracted.

2. The vehicle transport apparatus for parking systems according to claim 1, wherein one carrier of the carriers lifts and transports front wheels of the vehicle, and a remaining carrier lifts and transports rear wheels of the vehicle.

3. The vehicle transport apparatus for parking systems according to claim 1, wherein said at least one drive wheel is rotated by the drive motor through a chain, each carrier comprises two adjacent drive shafts, and said at least one drive wheel is provided on each drive shaft.

4. The vehicle transport apparatus for parking systems according to claim 3, further comprising: guide rollers provided in the opposite sides of the main frame of each carrier, so that the guide rollers are in rolling contact with vertical sidewalls formed in the platforms, thus guiding linear movement of the main frame.

5. The vehicle transport apparatus for parking systems according to claim 1, further comprising: a sensor provided at a predetermined position in each carrier so as to detect a position of a wheel of the vehicle, so that one carrier detects front wheels or rear wheels of the vehicle and is fixed at a position corresponding to the front or rear wheels and, thereafter, a remaining carrier detects remaining wheels while moving away from the fixed carrier, moves further for a time, and stops at a position adjacent to centers of the remaining wheels.

6. The vehicle transport apparatus for parking systems according to claim 5, further comprising: a distance maintenance sensor provided in one carrier so as to measure a distance from a remaining carrier, so that, when the one pair of carriers moves on the platforms without lifting the vehicle, constant distance between the carriers is maintained.

7. The vehicle transport apparatus for parking systems according to claim 5, further comprising a brake provided in said at least one drive wheel or the drive motor of one carrier, which is released when the wheels of the vehicle are lifted by the rotation of the arms such that the arms are aligned with centers of the wheels.

8. The vehicle transport apparatus for parking systems according to claim 1, further comprising: a third platform transporting the vehicle between the first platform and the second platform.

* * * * *